US008368715B2

(12) United States Patent
Kimijima

(10) Patent No.: US 8,368,715 B2
(45) Date of Patent: Feb. 5, 2013

(54) AUDIO SIGNAL PROCESSING APPARATUS, AUDIO SIGNAL PROCESSING METHOD, AND AUDIO SIGNAL PROCESSING PROGRAM

(75) Inventor: Tadaaki Kimijima, Tokyo (JP)

(73) Assignee: Sony Corporation, Tokyo (JP)

( * ) Notice: Subject to any disclaimer, the term of this patent is extended or adjusted under 35 U.S.C. 154(b) by 1607 days.

(21) Appl. No.: 11/827,646

(22) Filed: Jul. 12, 2007

(65) Prior Publication Data

US 2008/0019531 A1 Jan. 24, 2008

(30) Foreign Application Priority Data

Jul. 21, 2006 (JP) ..... 2006-199039

(51) Int. Cl.
*G09G 5/02* (2006.01)

(52) U.S. Cl. ..... 345/589; 345/654; 345/665; 345/690; 715/275; 381/104; 381/306; 700/94

(58) Field of Classification Search ..... 381/1, 17, 381/104–107, 98, 103, 306; 700/94; 345/589, 345/654, 665, 690; 715/275
See application file for complete search history.

(56) References Cited

U.S. PATENT DOCUMENTS

| | | | | |
|---|---|---|---|---|
| 3,783,192 | A | 1/1974 | Takahashi | |
| 3,825,684 | A | 7/1974 | Ito et al. | |
| 3,836,715 | A | 9/1974 | Ito et al. | |
| 4,747,142 | A | 5/1988 | Tofte | |
| 4,941,177 | A | 7/1990 | Mandell et al. | |
| 5,197,100 | A | 3/1993 | Shiraki | |
| 5,386,082 | A | 1/1995 | Higashi | |
| 5,537,435 | A | 7/1996 | Carney et al. | |
| 5,555,310 | A | 9/1996 | Minami et al. | |
| 5,636,283 | A | 6/1997 | Hill et al. | |
| 5,742,688 | A | 4/1998 | Ogawa et al. | |
| 6,078,669 | A | 6/2000 | Maher | |
| 6,130,949 | A | 10/2000 | Aoki et al. | |
| 6,269,166 | B1 | 7/2001 | Matsuo et al. | |
| 6,870,933 | B2 | 3/2005 | Roovers | |
| 6,920,223 | B1 | 7/2005 | Fosgate | |
| 7,369,668 | B1 * | 5/2008 | Huopaniemi et al. | 381/310 |
| 8,027,478 | B2 * | 9/2011 | Barry et al. | 381/17 |
| 2003/0035555 | A1 * | 2/2003 | King et al. | 381/103 |
| 2003/0152236 | A1 | 8/2003 | Morikawa | |
| 2004/0240686 | A1 * | 12/2004 | Gibson | 381/119 |
| 2005/0169482 | A1 | 8/2005 | Reams et al. | |
| 2006/0067541 | A1 | 3/2006 | Yamada et al. | |
| 2007/0055497 | A1 | 3/2007 | Kimijima | |

(Continued)

FOREIGN PATENT DOCUMENTS

| | | | |
|---|---|---|---|
| EP | 0593128 | A1 | 4/1994 |
| EP | 0608937 | A1 | 8/1994 |

(Continued)

*Primary Examiner* — Disler Paul
(74) *Attorney, Agent, or Firm* — Wolf, Greenfield & Sacks, P.C.

(57) ABSTRACT

An audio signal processing apparatus includes an examining unit and a generating unit. The examining unit examines, in each frequency band and at each localization angle, volume of an audio signal of two or more channels. The generating unit generates, on the basis of the examination result supplied from the examining unit, display data for showing the volume value in each frequency band and at each localization angle on an area that displays a frequency and a localization angle.

15 Claims, 13 Drawing Sheets

U.S. PATENT DOCUMENTS

| | | | | |
|---|---|---|---|---|
| 2007/0098181 | A1 | 5/2007 | Noguchi | |
| 2007/0110258 | A1 | 5/2007 | Kimijima | |
| 2008/0019533 | A1 | 1/2008 | Noguchi | |
| 2008/0130918 | A1 | 6/2008 | Kimijima | |
| 2008/0253592 | A1* | 10/2008 | Sanders et al. | 381/306 |

FOREIGN PATENT DOCUMENTS

| | | | |
|---|---|---|---|
| GB | 1411408 | A | 10/1975 |
| JP | 58-203483 | A | 11/1983 |
| JP | 61-081214 | U | 4/1986 |
| JP | 02-298200 | A | 12/1990 |
| JP | 03-236691 | A | 10/1991 |
| JP | 04-249484 | A | 9/1992 |
| JP | 04-296200 | A | 10/1992 |
| JP | 05-060096 | U | 8/1993 |
| JP | 06-311511 | A | 11/1994 |
| JP | 08-248070 | A | 9/1996 |
| JP | 09-172418 | A | 6/1997 |
| JP | 09-200900 | A | 7/1997 |
| JP | 09-511880 | A | 11/1997 |
| JP | 10-066198 | A | 3/1998 |
| JP | 10-136494 | A | 5/1998 |
| JP | 11-113097 | A | 4/1999 |
| JP | 2001-007769 | A | 1/2001 |
| JP | 2001-069597 | A | 3/2001 |
| JP | 2002-078100 | A | 3/2002 |
| JP | 2002-95096 | A | 3/2002 |
| JP | 2003-79000 | A | 3/2003 |
| JP | 2003-516069 | | 5/2003 |
| JP | 2003-274492 | A | 9/2003 |
| JP | 2004-064363 | A | 2/2004 |
| JP | 2004-135023 | A | 4/2004 |
| JP | 2004-333592 | A | 11/2004 |
| JP | 2005-244293 | A | 9/2005 |
| JP | 2006-014220 | A | 1/2006 |
| JP | 2006-080708 | A | 3/2006 |
| JP | 2006-121152 | A | 5/2006 |
| JP | 2006-135489 | A | 5/2006 |
| WO | WO 99/31938 | A1 | 6/1999 |

* cited by examiner

AUDIO SIGNAL PROCESSING APPARATUS, AUDIO SIGNAL PROCESSING METHOD, AND AUDIO SIGNAL PROCESSING PROGRAM

CROSS REFERENCES TO RELATED APPLICATIONS

The present invention contains subject matter related to Japanese Patent Application JP 2006-199039 filed in the Japanese Patent Office on Jul. 21, 2006, the entire contents of which are incorporated herein by reference.

BACKGROUND OF THE INVENTION

1. Field of the Invention

The present invention relates to an apparatus, a method, and a program for performing audio signal processing on an audio signal from a sound source localized at a given angle.

2. Description of the Related Art

Audio signals representing contents recorded on recording media, such as a compact disc (CD) and a digital versatile disc (DVD), and contents, such as television (TV) broadcast programs, contain audio signals from various kinds of sound sources. For example, music contents contain audio signals from sound sources, such as singing voices and sounds of musical instruments. In addition, TV broadcast program contents contain audio signals from sound sources, such as voices of the cast, sound effects, laughter, and clapping sounds.

Although these audio signals from sound sources are often recorded using different microphones during recording, even in that case, the audio signals are eventually downmixed to a predetermined number of channels, such as 2 channels (2 ch) and 5.1 channels (5.1 ch). At this time, the audio signals are adjusted by performing mixing or other processing so that each sound source is localized at the corresponding angle. Herein, the term "channel" may be abbreviated as "ch" as shown in the above with brackets.

Japanese Unexamined Patent Application Publication Nos. 2006-121152, 2006-080708, 2006-014220 describe techniques that allow separation of mixed audio signals from a plurality of sound sources and utilization of the separated signals.

SUMMARY OF THE INVENTION

If a playback apparatus or a TV receiver plays back (receives and demodulates) contents containing audio signals from a plurality of sound sources that are mixed as described above, the played audio is obtained such that each of the audio signals from the plurality of sound sources contained in the contents is localized at the corresponding localization angle adjusted during recording.

However, the localization sensation of sound source intended on the producer's side may be unacceptable to users depending on the user's preference or the like. In addition, functions to increase the variety of ways to enjoy the contents, such as extracting the volume of an audio signal, in a predetermined frequency range, from an sound source localized at a given angle or changing the volume of an audio signal, in a predetermined frequency range, from an sound source localized at a given angle, are also desired.

In view of the foregoing, embodiments of the present invention allow users to visually recognize information regarding each sound source of mixed audio signals from a plurality of sound sources and to adjust the audio signals in consideration of each sound source.

To this end, an audio signal processing apparatus according to an embodiment of the present invention includes an examining unit for examining, in each of predetermined frequency bands and at each of predetermined localization angles, volume of an audio signal of two or more channels, and a generating unit for generating, on the basis of the examination result supplied from the examining unit, display data for showing the volume value in each frequency band and at each localization angle on a two-dimensional plane that uses a frequency and a localization angle as two axes.

In the audio signal processing device according to the embodiment of the present invention, the examining unit examines the volume (the volume level) of the audio signal of two or more audio channels in each of the predetermined frequency bands at each of the predetermined localization angles. This allows users to recognize the volume level of the audio signal, in each frequency band, from a sound source existing at each localization angle. The generating unit then generates the display data for showing the volume value on the two-dimensional plane that uses the frequency and the localization angle as two axes.

With this configuration, the volume level of the audio signal, in each frequency band, from a sound source existing at each localization angle can be displayed on the display screen using the display data generated by the generating unit. This allows users to quickly recognize the state visually and accurately.

The audio signal processing apparatus according to the embodiment may further include a range specification receiving unit for receiving an input operation for instructing a specified range of the audio signal through an image displayed according to the display data supplied from the generating unit, a volume instruction receiving unit for receiving an instruction to adjust at least one of the volume of the audio signal inside the specified range and the volume outside the specified range that is specified according to the input operation received by the range specification receiving unit, and an adjusting unit for adjusting at least one of the volume of the audio signal inside the specified range and the volume of the audio signal outside the specified range according to the adjustment instruction received by the volume instruction receiving unit.

In the audio signal processing apparatus according to the embodiment, the range specification receiving unit receives the input operation for specifying the range of the audio signal from the user. This input operation is performed through the image displayed according to the display data generated by the generating unit.

Additionally, the volume instruction receiving unit receives the instruction to adjust at least one of the volume of the audio signal inside the range and the volume outside the range that is specified according to the input operation received by the range specification receiving unit. The adjusting unit adjusts at least one of the volume of the audio signal inside the specified range and the volume of the audio signal outside the specified range according to this volume adjustment instruction.

With this configuration, users can specify a range where a target sound source exists as the specified range. The users then can turn up the volume of the audio signal inside the specified range or the volume of the audio signal outside the specified range to increase the ambience. Alternatively, the users can adjust both of the volume of the audio signal inside the specified range and the volume of the audio signal outside the specified range to perform the volume adjustment while focusing on a target sound source contained in the audio signal to be played back. In such a manner, the adjustment of the volume balance, such as partially adjusting the volume of the audio signal to be played back and playing back the audio signal according to the user's preference, can be performed.

The embodiments of the present invention allow users to visually recognize the information regarding each sound source for an audio signal obtained by mixing audio signals from a plurality of sound sources. Based on this, the users can perform a volume adjustment operation in consideration of each sound source and can increase the variety of ways to enjoy the contents.

DESCRIPTION OF THE PREFERRED EMBODIMENTS

An apparatus, a method, and a program according to embodiments of the present invention will be described below with reference to the drawings.

[First Embodiment]

Description of a first embodiment is given below for an example of an audio signal playback apparatus (hereinafter, simply referred to as a playback apparatus) to which an apparatus, a method, and a program according to embodiments of the present invention are applied. As described in detail below, the playback apparatus according to the first embodiment has a function to show, in each frequency band and at each localization angle, volume values of mixed audio signals of two or more channels from a plurality of sound sources on a two-dimensional plane that uses the frequency and the localization angle as two axes through color brightness.

Figure 1:
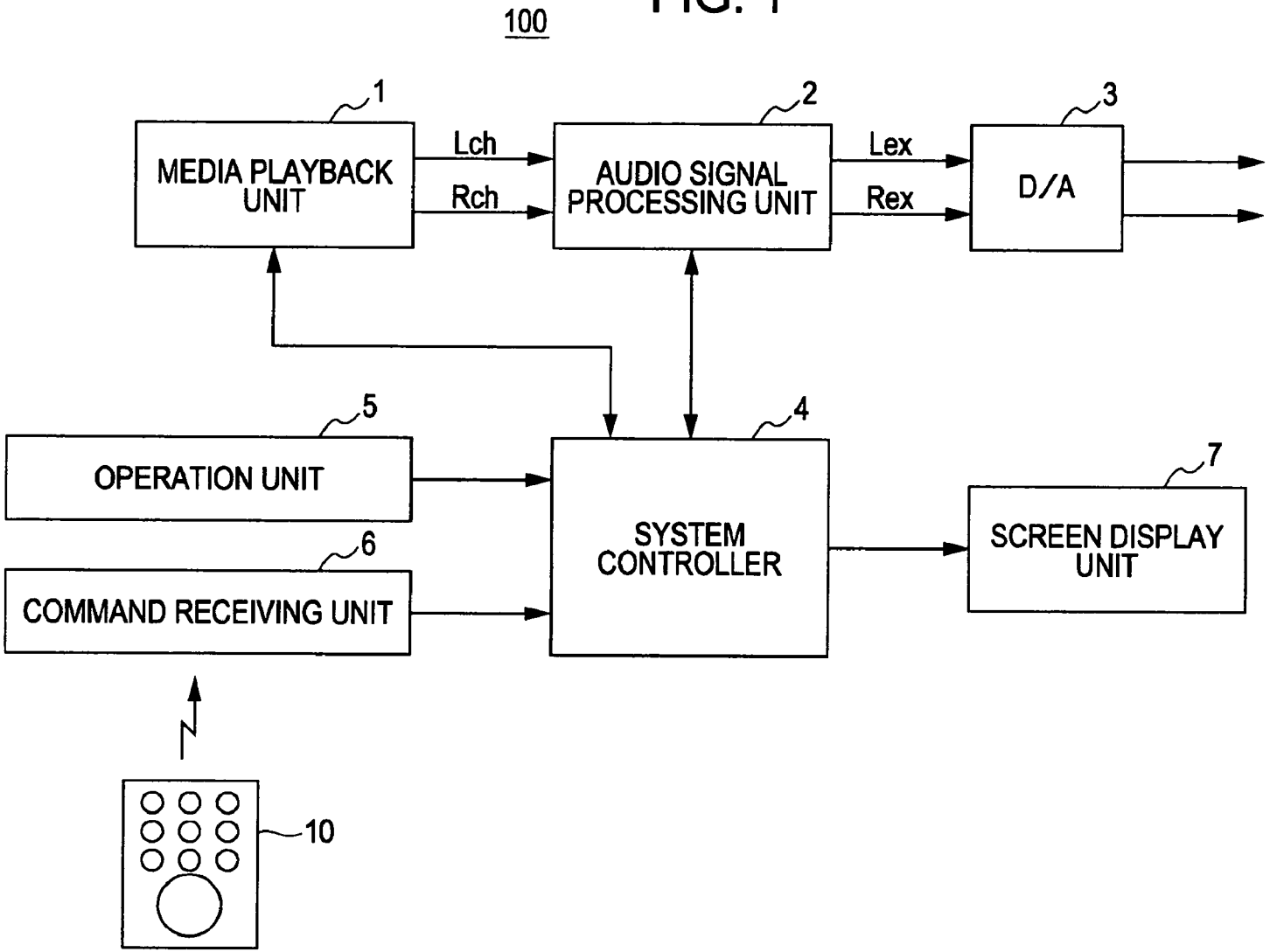
FIG. 1 is a block diagram for illustrating an audio signal playback apparatus (a playback apparatus according to a first embodiment) to which one embodiment of the present invention is applied.

FIG. 1 is a block diagram for illustrating a playback apparatus 100 according to the first embodiment. As illustrated in FIG. 1, the playback apparatus 100 according to the first embodiment includes a media playback unit 1, an audio signal processing unit 2, a digital/analog (D/A) converter 3, a system controller 4, an operation unit 5, a command receiving unit 6, and a screen display unit 7. The playback apparatus 100 can be remotely controlled with a remote commander 10.

The media playback unit 1 is capable of reading out audio signals recorded on predetermined recording media and of playing back the audio signals. The predetermined recording media include optical disc recording media such as, for example, a compact disc (CD), a digital versatile disc (DVD), and a blu-ray disc, magneto-optical disc recording media such as a Mini Disc® (MD), magnetic disc recording media such as a hard disc drive, and recording media including a semiconductor memory therein.

In this embodiment, it is assumed that contents represented by two-channel (the left channel (Lch) and the right channel (Rch)) audio signals are recorded on recording media supported by the media playback unit 1. The Lch and Rch audio signals played back by the media playback unit 1 are supplied to the audio signal processing unit 2.

The audio signal processing unit 2 examines, in each of predetermined frequency bands and at each of predetermined localization angles, volume values of the Lch and Rch audio signals supplied from the media playback unit 1. The audio signal processing unit 2 then supplies the examination result to the system controller 4, which will be described later. The audio signal processing unit 2 also supplies the Lch and Rch audio signals to the D/A converter 3 as playback audio signals Lex and Rex, respectively.

Various methods for examining the volume values of the two-channel audio signals in each frequency band at each localization angle that are employable by the audio signal processing unit 2 are known. For example, a method described in a previously filed Japanese Patent Application No. 2005-327237 can be used.

The above-cited Japanese Patent Application No. 2005-327237 suggests a technique for adjusting an audio signal from a sound source localized at each localization angle. More specifically, audio signals are divided into a predetermined number of frequency bands (e.g., into 4000 frequency bands each having a bandwidth of 11 Hz) through a frequency band division processing. Localization angles of the audio signals having been divided into each frequency band are examined to extract or remove only an audio signal of a sound source localized at a given angle or to adjust the volume thereof. Use of this technique permits examination of the volume in each frequency band and at each localization angle.

The D/A converter 3 performs D/A conversion on the audio signals Lex and Rex supplied to the D/A converter 3 from the audio signal processing unit 2. The D/A converter 3 then outputs the analog Lch audio signal and the analog Rch audio signal.

Although not shown, the system controller 4 is a microcomputer, which is constituted by a central processing unit (CPU), a read only memory (ROM), a random access memory (RAM), and a nonvolatile memory such as an electrically erasable and programmable ROM (EEPROM) connected to each other through a CPU bus. The system controller 4 controls each unit of the playback apparatus 100 according to the first embodiment.

As illustrated in FIG. 1, the operation unit 5, the command receiving unit 6, and the screen display unit 7 are connected to the system controller 4. The operation unit 5 includes various operation keys, which are provided on a housing of the playback apparatus 100. The operation unit 5 is capable of receiving user input operations performed thereon, and of generating command signals corresponding to the received input operations, and of supplying the command signals to the system controller 4.

The command receiving unit 6 receives command signals, e.g., infrared signals, emitted from the remote commander 10. The command receiving unit 6 then converts the command signals into electric signals, and supplies the electric signals to the system controller 4. The remote commander 10 is also equipped with various operation keys. As described above, the command receiving unit 6 converts the infrared command signals, corresponding to operations performed on these operation keys provided on the remote commander 10, into electric signals, and supplies the electric signals to the system controller 4.

In response to the command signals supplied from the operation unit 5 or the command receiving unit 6, the system controller 4 controls each unit of the playback apparatus 100 according to the first embodiment. With such a configuration, the playback apparatus 100 executes operations corresponding to the user input operations. For example, the operation unit 5 or the remote commander 10 is equipped with an operation key used for instructing playback of contents recorded on a recording medium loaded into the media playback unit 1. Upon receiving the command signal corresponding to the operation performed on the operation key, the system controller 4 controls the media playback unit 1 to start a content playback operation.

Furthermore, as described above, the system controller 4 according to the first embodiment generates display data on the basis of the result, supplied from the audio signal processing unit 2, of examining the volume value in each of the predetermined frequency bands and at each of the localization angles. The generated display data is used for displaying information regarding each audio signal from the corresponding sound source contained in the audio signals to be played back on a display screen of the screen display unit 7. The system controller 4 then supplies the generated data to the screen display unit 7.

The screen display unit 7 includes a display device, such as, for example, a liquid crystal display (LCD), an organic electroluminescence (EL) panel, a plasma display panel (PDP), and a cathode ray tube (CRT), and a control circuit therefor. The screen display unit 7 is supplied with the display data from the system controller 4, and displays an image corresponding to the display data on a display screen constituted by the display device.

Accordingly, in the playback apparatus 100 according to the first embodiment, upon receiving, through the operation unit 5 or through the remote commander 10 and the command receiving unit 6, the instruction to play back the audio signals recorded on a recording medium loaded into the media playback unit 1, the system controller 4 controls the media playback unit 1 to read out the target audio signal from the recording medium, and performs the playback operation through the audio signal processing unit 2 and the D/A converter 3.

At the same time, the system controller 4 generates the display data for the information regarding each audio signal from the corresponding sound source contained in the audio signals to be played back on the basis of the examination result of the volume value at each localization angle in each of the predetermined frequency bands that is supplied from the audio signal processing unit 2. The system controller 4 then supplies the generated data to the screen display unit 7, thereby displaying the information regarding each audio signal from the corresponding sound source contained in the audio signals to be played back on the display screen of the screen display unit 7.

Figure 2:
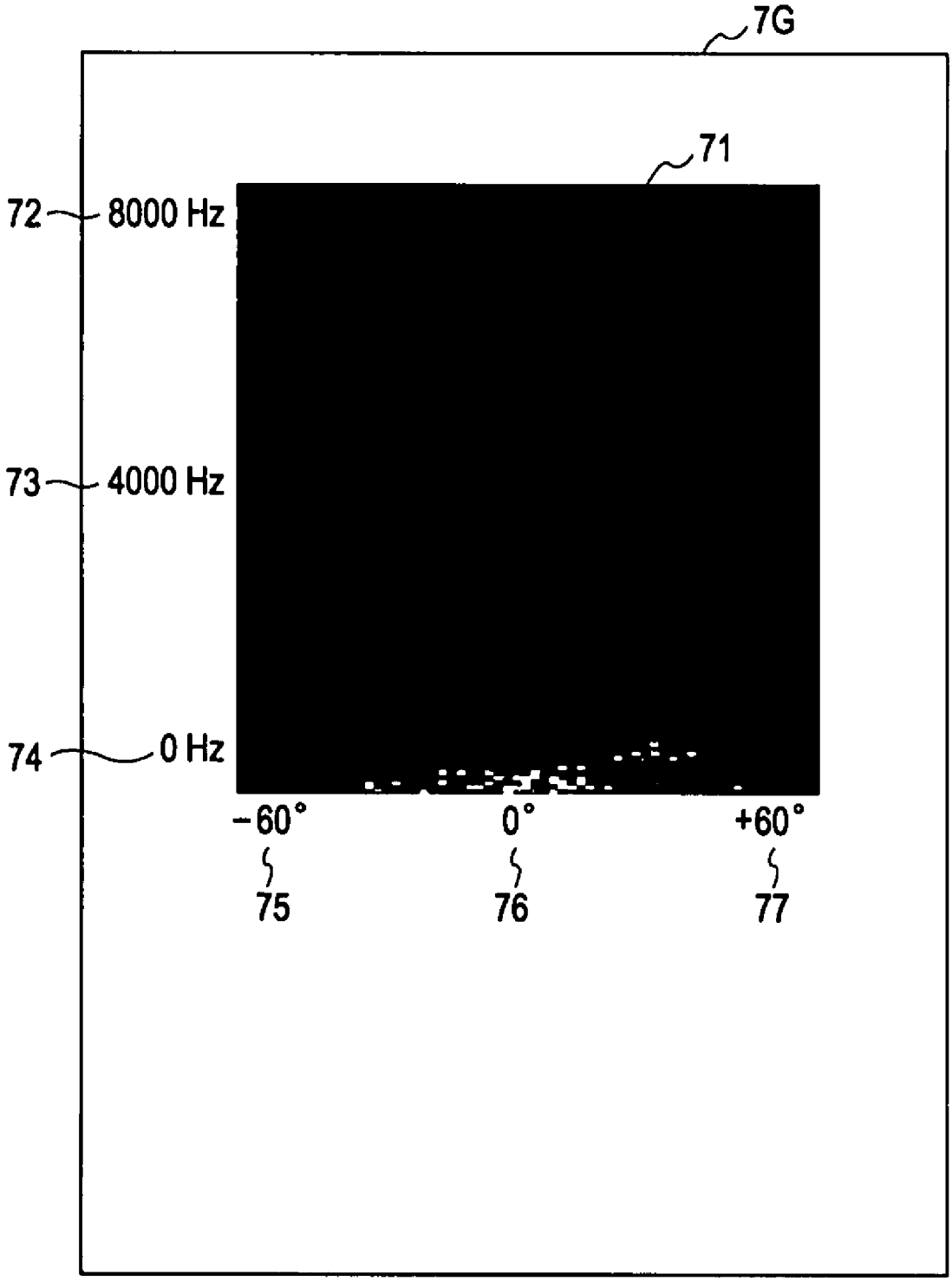
FIG. 2 is a diagram for illustrating a display example of information, regarding each audio signal from a corresponding sound source contained in audio signals to be played back, which is displayed on a display screen.

FIG. 2 is a display example of information, regarding each audio signal of the corresponding sound source contained in the audio signals to be played back, that is displayed on a display screen of the screen display unit 7. More specifically, FIG. 2 shows an example in which the volume value of the audio signal from the sound source that exists at each localization angle in each predetermined frequency band is expressed by color brightness. Referring to FIG. 2, an outer frame indicates a display screen 7G of the screen display unit 7. The display screen 7G includes a volume display portion 71, which corresponds to an area for displaying the information regarding each audio signal from the corresponding sound source contained in the audio signals to be played back.

According to the first embodiment, as shown in FIG. 2, the horizontal axis and the vertical axis of the volume display portion 71 displayed on the display screen 7G of the screen display unit 7 indicate the localization angle of a sound image of each sound source and the frequency, respectively. In the first embodiment, the center of the horizontal axis is set to 0 degrees, and a range of 120 degrees, i.e., 60 degrees for each side, is shown. In addition, the vertical axis shows a frequency range of 0 Hz to 8000 Hz.

In the example illustrated in FIG. 2, a black area in the volume display portion 71 corresponds to a component having the low volume level, whereas a white area corresponds to a component having the high volume level. As described above, the horizontal axis of the volume display portion 71 represents the localization angle. Thus, the volume of the audio signal of the sound source that is localized on the left is shown on the left side. Similarly, the volume of the audio signal of the sound source that is localized on the right and at the center is displayed on the right and at the center of the volume display portion, respectively. In addition, as described above, the vertical axis of the volume display portion 71 represents the frequency. Thus, the volume in the high-frequency band is shown on the upper side. Similarly, the volume in the low-frequency band and the middle-frequency band is displayed on the lower side and at the center, respectively.

Accordingly, the lower-right area of the volume display portion 71 indicates the volume of the audio signal, in low-frequency band, from a sound source localized on the right. That is, in the volume display portion 71, three elements, i.e., the localization angle, the frequency, and the volume, are expressed using three elements, i.e., the horizontal axis, the vertical axis, and the color brightness. Also, in FIG. 2, reference numerals 72, 73, and 74 indicate values of the corresponding frequencies, whereas reference numerals 75, 76, and 77 indicate values of the corresponding localization angles.

In the case of the example illustrated in FIG. 2, it is known that sound sources having high volume level exist in a portion in a range of 60 degrees (±60 degrees) on the right and left sides of the center "0 degrees" and not greater than the frequency of 4000 Hz, more specifically, a portion in a range of 30 degrees (±30 degrees) on the right and left sides and not greater than the frequency of 2000 Hz.

A software implementation example according to the first embodiment of the present invention will be described next.

Figure 3:
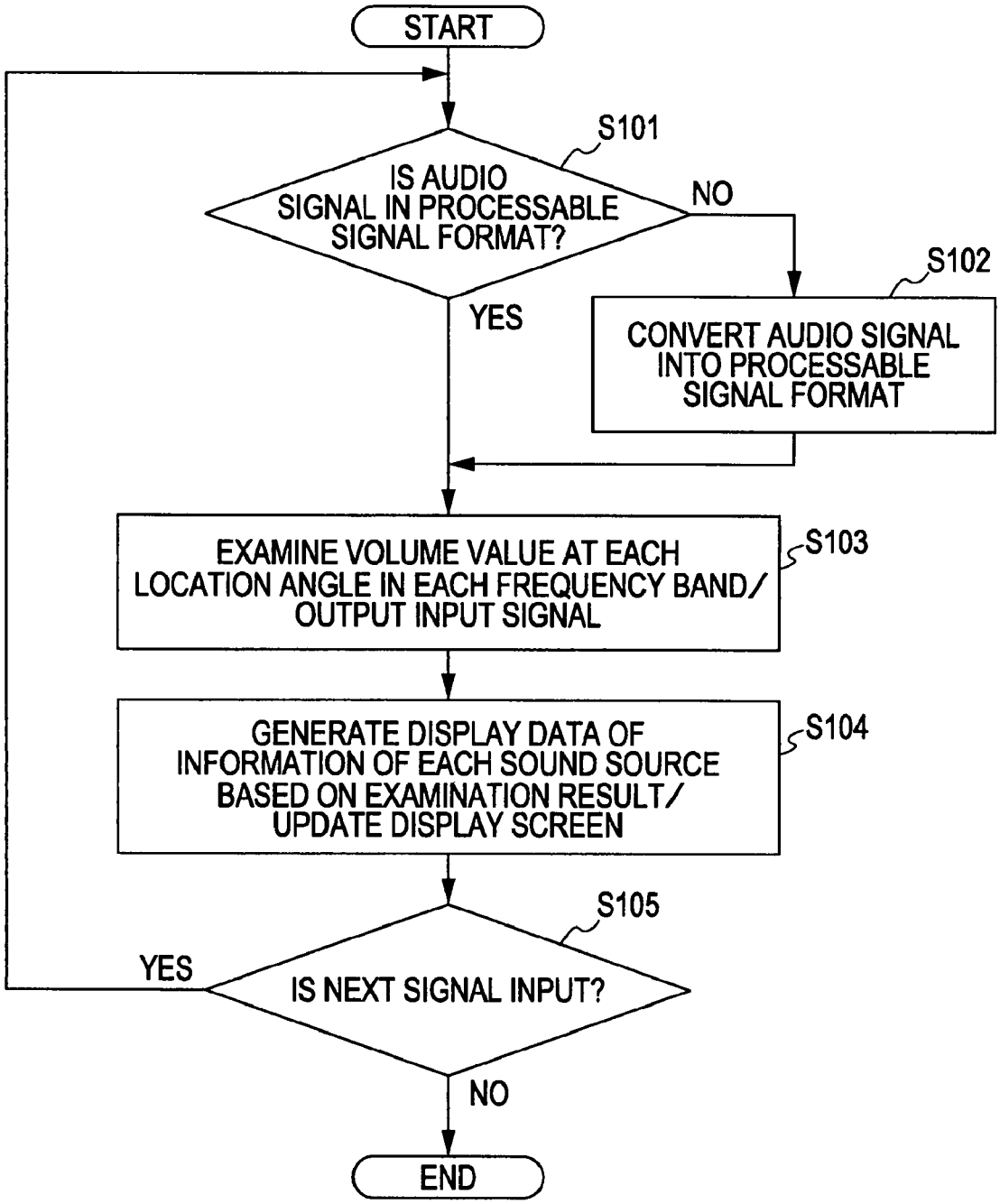
FIG. 3 is a flowchart illustrating a procedure of an operation for displaying volume executed by a playback apparatus according to a first embodiment.

FIG. 3 is a flowchart for illustrating processing executed by the playback apparatus 100 according to the first embodiment of the present invention. The flowchart corresponds to an example in which the embodiment of the present invention is realized as software.

The processing illustrated in FIG. 3 is executed by the system controller 4 in cooperation with the audio signal processing unit 2 and the screen display unit 7 to play back the audio signals recorded on the recording medium loaded into the media playback unit 1 upon receiving an audio signal playback instruction through the operation unit 5 or through the remote commander 10 and the command receiving unit 6.

The system controller 4 of the playback apparatus 100 first controls the audio signal processing unit 2 to determine whether or not the audio signal to be played back is in a signal format processable by the playback apparatus (STEP S101). For example, if the audio signal to be played back is compressed according to a compression method, such as MPEG-1 audio layer 3 (MP3), or if the audio signal to be played back has the sampling frequency different from the sampling frequency of the expected signal format, the audio signal processing unit 2 cannot execute the processing in the current signal format. In such a case, the audio signal processing unit 2 converts the audio signal to be played back into a processable signal format.

That is, if a positive result is obtained in the determination operation performed at STEP S101, the process proceeds to STEP S103. On the other hand, if a negative result is obtained in the determination operation performed at STEP S101, it is indicated that the audio signal processing unit 2 cannot execute the processing on the audio signal to be played back. Thus, the process proceeds to STEP S102.

Accordingly, if the audio signal to be played back is determined not to be in a processable signal format in the determination operation performed at STEP S101, the system controller 4 controls the audio signal processing unit 2 to convert the audio signal to be played back into an audio signal in a processable signal format (STEP S102).

After performing the processing at STEP S102, or if the signal format of the audio signal to be played back is determined to be a processable signal format in the determination operation performed at STEP S101, the system controller 4 controls the audio signal processing unit 2 to examine volume of the audio signal to be played back in each frequency band and at each localization angle. At the same time, the system controller 4 supplies the audio signal to be played back to the D/A converter 3 to play back the audio signal (STEP S103).

Thereafter, the system controller 4 generates display data for the information regarding the each audio signal from the corresponding sound source contained in the audio signal to be played back on the basis of the examination result, supplied from the signal processing unit 2, on the volume of the audio signal to be played back in each frequency band and at each localization angle. The system controller 4 then supplies the generated data to the screen display unit 7 to update the information, regarding each audio signal from the corresponding sound source contained in the audio signal to be played back, that is displayed on the display screen 7G of the screen display unit 7 (STEP S104).

The system controller 4 then determines whether or not the next audio signal that is continuously input to the audio signal processing unit 2 exists (STEP S105). A positive result obtained in the determination operation performed at STEP S105 indicates that the audio signal to be processed next exists. Thus, the system controller 4 repeats the processing from STEP S101 again. On the other hand, if a negative result is obtained in the determination operation performed at STEP S105, the processing target does not exist. Thus, the system controller 4 terminates the processing illustrated in FIG. 3.

As described above, the playback apparatus 100 according to the first embodiment can realize a function to express, in each frequency band and at each localization angle, the value values of mixed audio signals of two or more channels by the color brightness on a two-dimensional plane that uses the frequency and the localization angle as the two axes. By expressing the volume values of the audio signals of two or more channels in each frequency band and at each localization angle by the color brightness on the two-dimensional plane defined by two axes of the frequency and the localization angle, the characteristics of the audio signals being played back can be easily understood.

[Second Embodiment]

A second embodiment of the present invention will be described next. As in the case of the above-described first embodiment, description of the second embodiment is given below for an example of an audio signal playback apparatus to which an apparatus, a method, and a program according to an embodiment of the present invention are applied. The playback apparatus 200 according to the second embodiment described below is a modification of the playback apparatus 100 according to the first embodiment. The playback apparatus 200 can adjust a volume balance by allowing users to select a specific frequency range and a specific localization angle range through user operations and by adjusting at least one of the volume of audio signal inside the selected range and the volume of audio signal outside the selected range.

Figure 4:
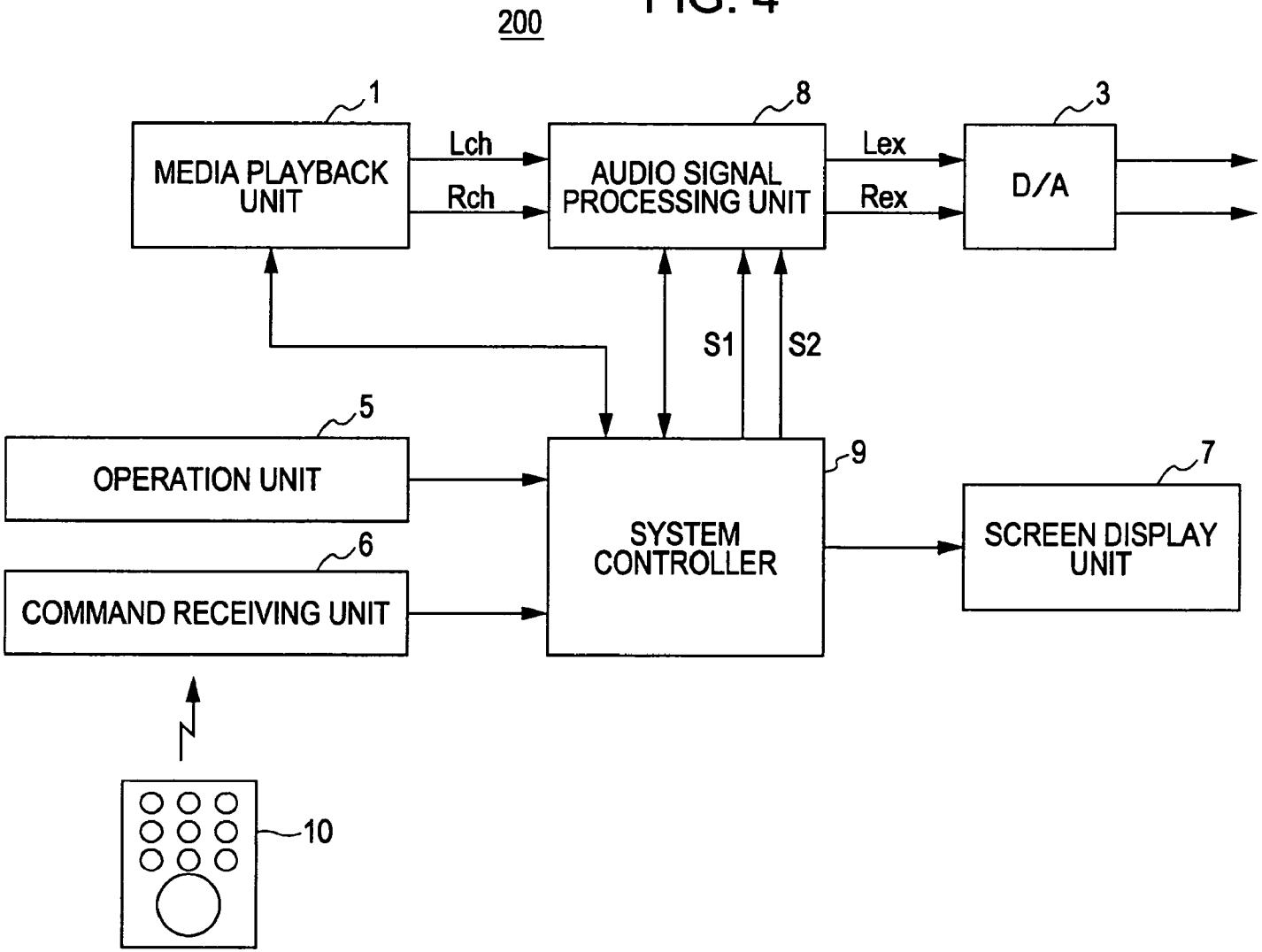
FIG. 4 is a block diagram for illustrating another example of an audio signal playback apparatus (a playback apparatus according to a second embodiment) to which one embodiment of the present invention is applied.

FIG. 4 is a block diagram for illustrating the playback apparatus 200 according to the second embodiment. In FIG. 4, same or similar parts as those of the playback apparatus 100 according to the first embodiment that has been described using FIG. 1 are denoted by like reference numerals, and the description of those parts is omitted. As is clear from the comparison between FIG. 4 and FIG. 1, differences between the playback apparatus 200 according to the second embodiment illustrated in FIG. 4 and the playback apparatus 100 according to the first embodiment illustrated in FIG. 1 are functions of an audio signal processing unit 8 and a system controller 9.

As in the case of the playback apparatus 100 according to the first embodiment that has been described using FIG. 1, Lch (left channel) and Rch (right channel) audio signals played back by a media playback unit 1 are supplied to the audio signal processing unit 8 in the playback apparatus 200 according to the second embodiment.

The audio signal processing unit 8 is supplied with the Lch and Rch audio signals from the media playback unit 1 and with a frequency range/localization angle range instruction signal S1 and a volume balance instruction signal S2 from the system controller 9, which will be described later. The audio signal processing unit 8 multiplies the audio signal from the sound source inside the specified frequency and localization angle ranges contained in the Lch and Rch audio signals by a gain determined by the volume balance instruction signal S2. The audio signal processing unit 8 also multiplies the audio signal from the sound source outside the specified frequency and localization angle ranges by a gain determined by the volume balance instruction signal S2.

As described above, the audio signal processing unit 8 can multiply the audio signals to be played back inside the specified range and outside the specified range by the instructed gain, and can output the Lch and Rch audio signals whose gain is adjusted in the range specified by the frequency and the localization angle.

Furthermore, the audio signal processing unit 8 examines the volume of the audio signal, multiplied by the gain as described above, in each frequency band and at each localization angle, and supplies the examination result to the system controller 9, which will be described later. The examination of the volume in each frequency band and at each localization angle is performed in the same manner as that performed by the above-described audio signal processing unit 2 of the playback apparatus 100 according to the first embodiment.

The audio signal processing unit 8 supplies the Lch and Rch audio signals having undergone the audio signal processing, such as the gain adjustment, to a D/A converter 3 as audio signals Lex and Rex. The D/A converter 3 performs D/A conversion on the audio signals Lex and Rex supplied thereto to generate and output analog Lch and Rch audio signals.

As described above, the system controller 9 is supplied with the examination result on the volume of the gain-adjusted audio signals to be played back in each frequency band and at each localization angle from the audio signal processing unit 8. The system controller 9 generates display data for information, regarding each audio signal from the corresponding sound source contained in the gain-adjusted audio signal to be played back, to be displayed on a display screen of a screen display unit 7. The system controller 9 then supplies the generated data to the screen display unit 7.

The same operation for generating the display data for the information regarding each audio signal from the corresponding sound source contained in the gain-adjusted audio signals to be played back as that performed by the system controller 4 according to the first embodiment that has been described using FIG. 1 is performed. With such a configuration, the playback apparatus 200 according to the second embodiment can also display the information regarding each audio signal from the corresponding sound source contained in the gain-adjusted audio signals to be played back on a display screen of the screen display unit 7.

As described above, in response to user input operations, the system controller 9 of the playback apparatus 200 according to the second embodiment generates the frequency range/localization angle range instruction signal S1 and the volume balance instruction signal S2. The system controller 9 then supplies the generated instruction signals S1 and S2 to the audio signal processing unit 8.

The system controller 9 can receive the user input operations through an operation unit 5 or through a remote commander 10 and a command receiving unit 6. Herein, the description is given for an example in which the system controller 9 receives the user input operations through the remote commander 10 and the command receiving unit 6.

Figure 5:
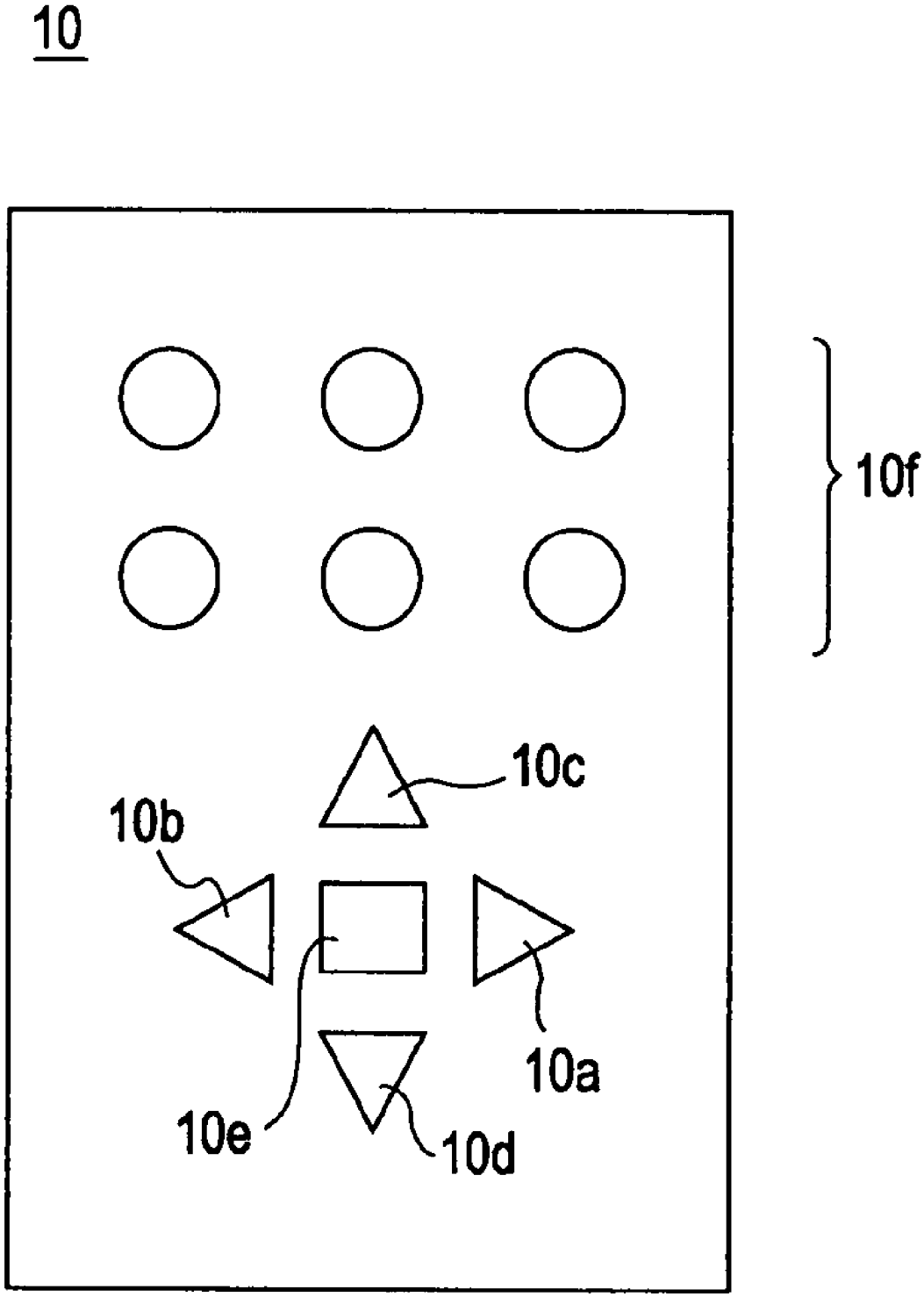
FIG. 5 is an example of appearance of a remote commander 10 for a playback apparatus illustrated in FIG. 4.

FIG. 5 illustrates an example of appearance of the remote commander 10 for the playback apparatus 200 according to the second embodiment. As illustrated in FIG. 5, for example, direction instructing keys and an enter key are provided on the remote commander 10. More specifically, as illustrated in FIG. 5, a right key 10*a*, a left key 10*b*, an upward key 10*c*, and a downward key 10*d* are the direction instructing keys used for instructing a moving direction of a cursor. An execution key 10*e* is the enter key that instructs execution of processing. In addition to these keys, operation keys 10*f* including various function keys are also provided.

In the playback apparatus 200 according to the second embodiment, users specify the frequency range, the localization angle range, and the volume balance using the direction instructing keys 10*a*, 10*b*, 10*c*, and 10*d* and the enter key 10*e* provided on the remote commander 10 while confirming the information regarding the sound sources displayed on a display screen 7G of the screen display unit 7.

Upon receiving these instructions, the system controller 9 generates the frequency range/localization angle range instruction signal S1 and the volume balance instruction signal S2 according to the received instructions. The system controller 9 then supplies these instruction signals S1 and S2 to the audio signal processing unit 8. Accordingly, the audio signal processing unit 8 multiplies the audio signals from the sound sources inside the specified frequency and localization angle ranges by the gain determined by the volume balance instruction signal S2. The audio signal processing unit 8 also multiplies the audio signals from the sound sources outside the specified frequency and localization angle ranges by the gain determined by the volume balance instruction signal S2. In this way, the audio signal whose gain is adjusted according to the user's instructions can be played back.

A procedure for setting the frequency range and the localization angle range within which the volume balance is changed and a procedure for changing the volume balance between inside and outside the specified range will be described in detail below in association with the operations performed on the remote commander 10 and images, displayed on the display screen 7G of the screen display unit 7, that change in response to the operations.

Figure 6:
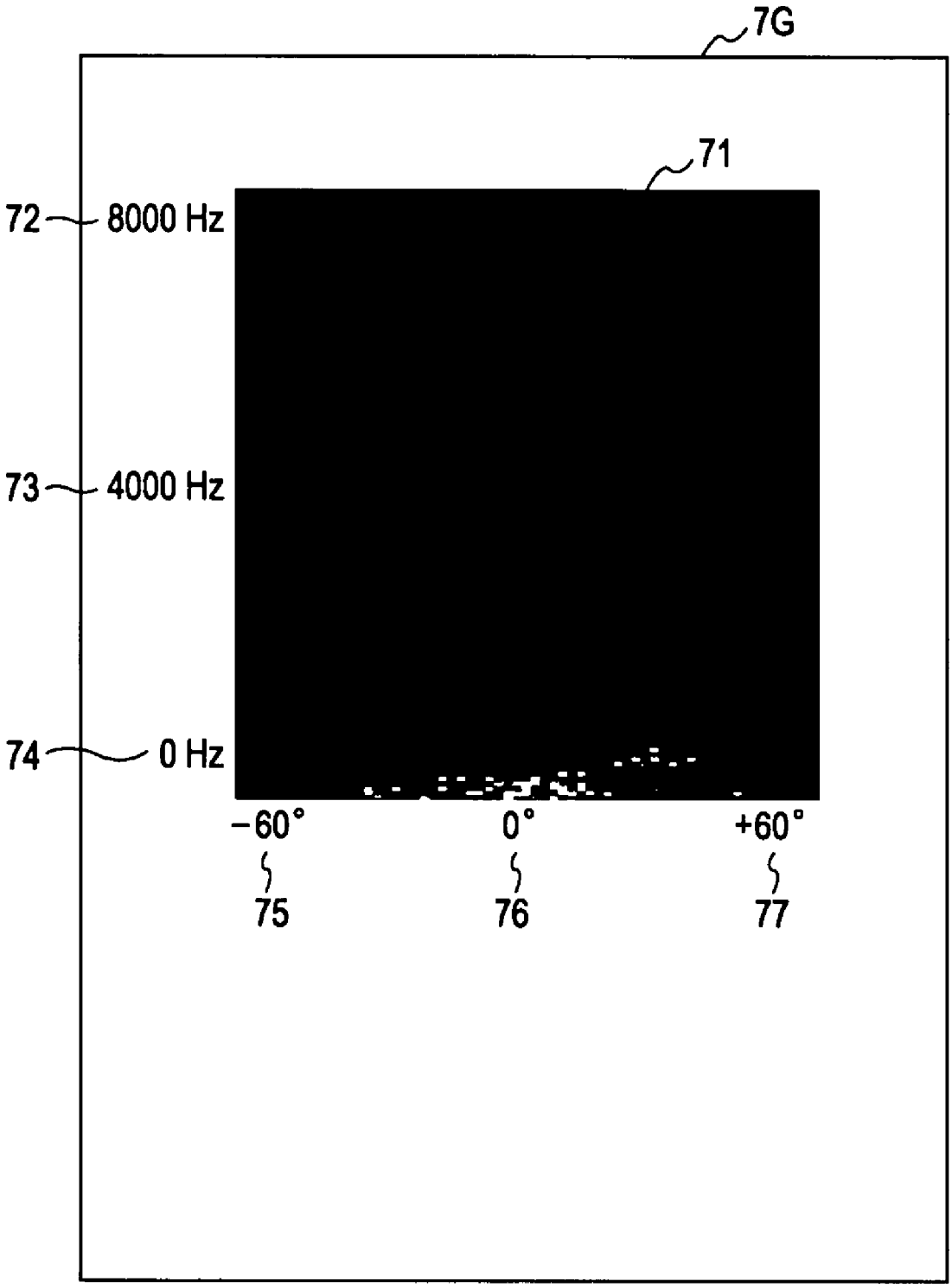
FIG. 6 is a diagram for illustrating a display example of an image displayed on a display screen 7G of a playback apparatus illustrated in FIG. 4.

FIG. 6 illustrates a display example of an image displayed by the system controller 9 on the display screen 7G of the screen display unit 7 on the basis of the examination result supplied from the audio signal processing unit 8 when audio signals recorded on a recording medium loaded into the media playback unit 1 are played back in the playback apparatus 200 according to the second embodiment.

The display example illustrated in FIG. 6 is basically the same as that displayed on the display screen 7G of the screen display unit 7 during playback of the audio signals in the playback apparatus 100 according to the first embodiment, which has been described using FIG. 2. Accordingly, in FIG. 6, same or similar parts as those shown FIG. 2 are denoted by like reference numerals, and the detailed description of those parts is omitted.

As shown in FIG. 6, also in the playback apparatus 200 according to the second embodiment, the horizontal axis and the vertical axis of a volume display portion 71 displayed on the display screen 7G of the screen display unit 7 indicate the localization angle of a sound image of each sound source and the frequency, respectively. In the second embodiment, the center of the horizontal axis indicating the localization angle is set to 0 degrees, and a range of 120 degrees, i.e., 60 degrees for each side, is shown. In addition, the vertical axis indicating the frequency shows a range of 0 Hz to 8000 Hz.

As in the case of the volume display portion 71 shown in FIG. 2, the volume level is represented by the color brightness in the volume display portion 71 shown in FIG. 6. That is, three elements, i.e., the localization angle, the frequency, and the volume, are represented using three elements, i.e., the horizontal axis, the vertical axis, and the color brightness. Furthermore, in the case of the playback apparatus 200 according to the second embodiment, the frequency and localization angle ranges specified through the remote commander 10 are displayed on the volume display portion 71, which helps users to change the volume balance within a given range.

More specifically, as described using FIG. 5, a user of the playback apparatus 200 according to the second embodiment operates the operation keys, such as the right key 10*a*, the left key 10*b*, the upward key 10*c*, the downward key 10*d*, and the execution key 10*e*, provided on the remote commander 10 for the playback apparatus 200. In such a manner, the user can set, in the playback apparatus 200, the frequency and localization angle ranges for which the volume balance is changed, and can change each volume balance.

Figure 7:
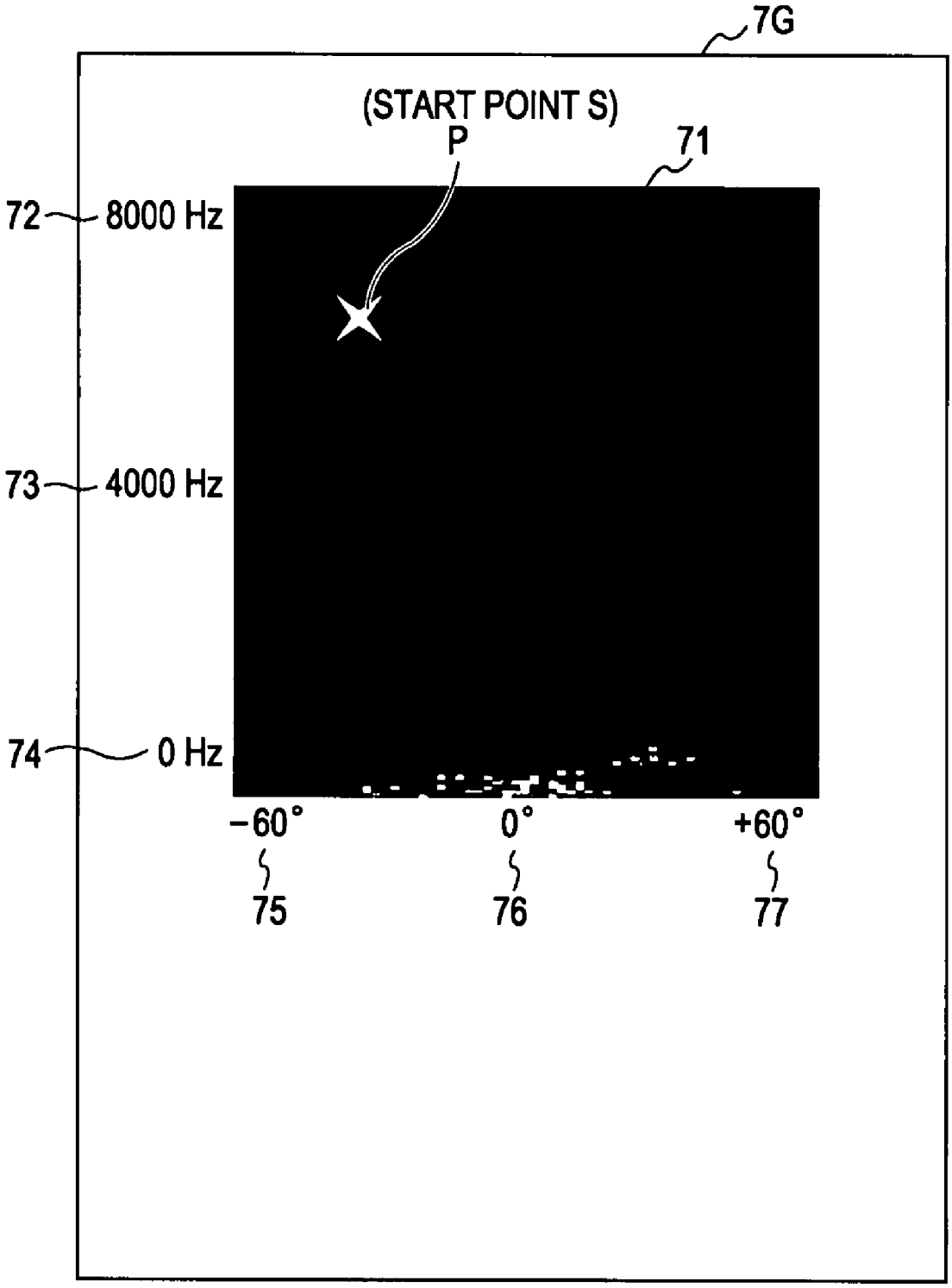
FIG. 7 is a diagram for illustrating a display example of an image displayed on a display screen 7G of a playback apparatus illustrated in FIG. 4.
Figure 8:
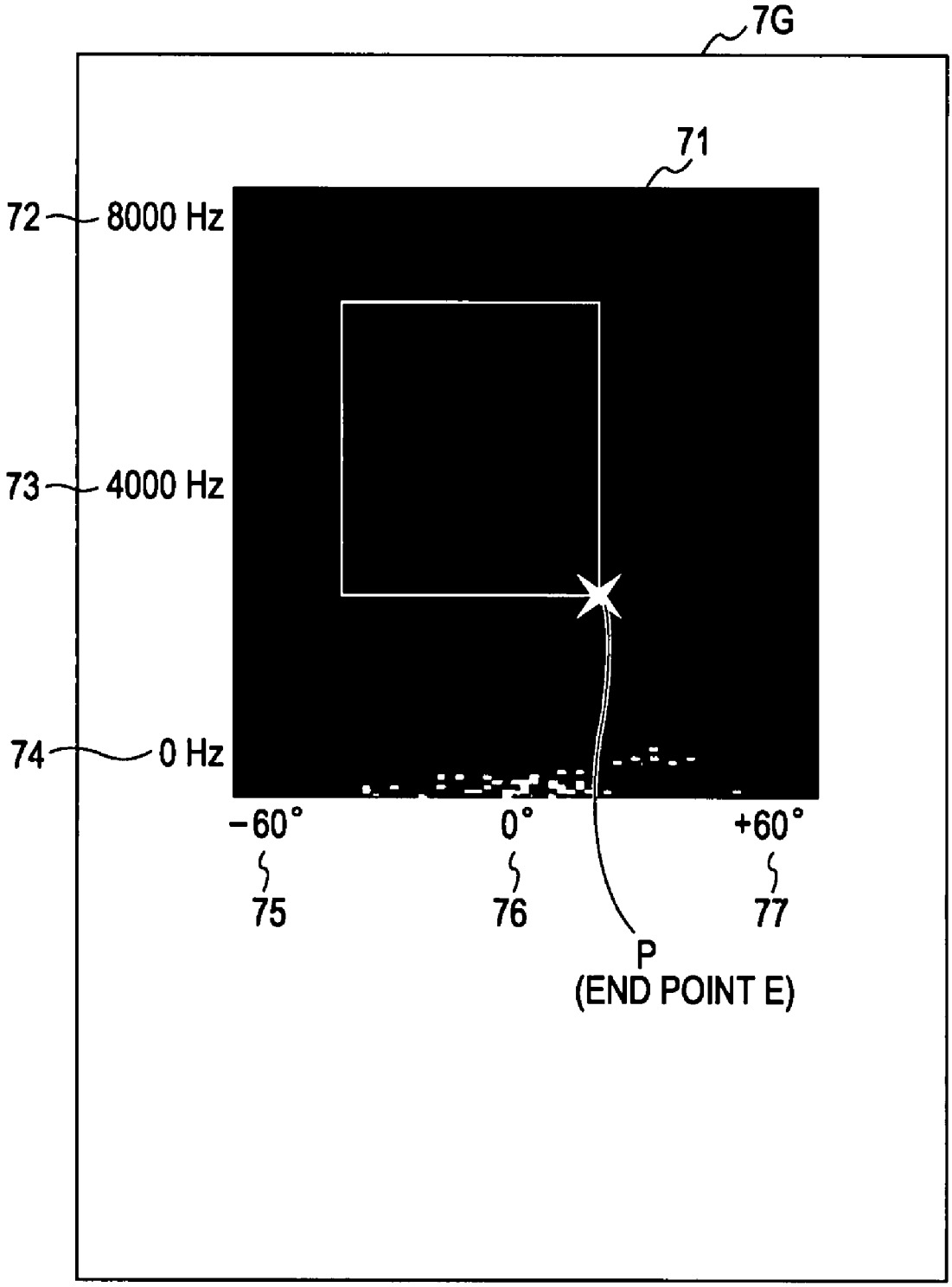
FIG. 8 is a diagram for illustrating a display example of an image displayed on a display screen 7G of a playback apparatus illustrated in FIG. 4.

FIGS. 7 and 8 illustrate display examples of images displayed when the user specifies the frequency and localization angle ranges. Detailed description will be given below with reference to FIGS. 7 and 8.

As a first step, a pointer (an indicator) P used for specifying a start point and an end point is first displayed in response to a predetermined operation as shown in FIG. 7. The user operates the right key 10*a*, the left key 10*b*, the upward key 10*c*, and the downward key 10*d* to move the pointer P to a position to be set as a start point S of the frequency and localization angle ranges to be selected. The user presses the execution key 10*e* to set the start point S.

More specifically, the user operates the right key 10*a* to move the start point S of the localization angle range to the right. The user operates the left key 10*b* to move the start point S of the localization angle range to the left. Similarly, the user operates the upward key 10*c* to move the start point S of the frequency range in the high-frequency band direction. The user operates the downward key 10*d* to move the start point S of the frequency range in the low-frequency band direction. The user operates the execution key 10*e* to set the start point S of the frequency and localization angle ranges.

By displaying the pointer P that indicates the current position of the start point over the display area of the volume display portion 71 in this manner, the user can specify the start point S more easily.

After setting the start point S, as a second step, the user further operates the right key 10*a*, the left key 10*b*, the upward key 10*c*, and the downward key 10*d* to move the pointer P as shown in FIG. 8, thereby specifying an end point E of the localization angle and frequency ranges to be selected. The user then operates the execution key 10*e* to set the end point E.

More specifically, the user operates the right key 10*a* to move the end point E of the localization angle range to the right. The user operates the left key 10*b* to move the end point E of the localization angle range to the left. Similarly, the user operates the upward key 10*c* to move the end point E of the frequency range in the high-frequency band direction. The user operates the downward key 10*d* to move the end point E of the frequency range in the low-frequency band direction. The user operates the execution key 10*e* to set the end point E of the frequency and localization angle ranges.

At this time, the system controller 9 generates the display data according to the instruction input by the user, and supplies the display data to the screen display unit 7. As shown in FIG. 8, a rectangle having the selected start point S and the end point E currently indicated as the vertices on a diagonal line is displayed over the volume display portion 71, thereby allowing the user to visually recognize the localization angle and frequency ranges that the user currently specifies. Furthermore, the system controller 9 controls the audio signal processing unit 8 to output only audio signals from sound sources exist inside the specified range, thereby allowing the user to aurally recognize the specified localization angle and frequency ranges. With such a configuration, the user can perform specification of the end point E more easily.

After setting the start point and the end point of the frequency and localization angle ranges in the above-described manner, as a third step, the user changes the volume balance between inside and outside the range enclosed by the rectangle having these start point S and end point E as the vertices on a diagonal line by operating the upward key 10*c* and the downward key 10*d* of the remote commander 10.

More specifically, the user operates the upward key 10*c* to turn up the volume of the sound sources inside the range specified by the start point S and the end point E and to turn down the volume of the sound sources outside the specified range. Conversely, the user operates the downward key 10*d* to turn down the volume of the sound sources inside the range specified by the start point S and the end point E and to turn up the volume of the sound sources outside the specified range.

Alternatively, the user can select either a range inside or outside the range specified by the start point S and the end point E, and can turn up or turn down the volume of the audio signal in the selected range. That is, the user does not perform the volume adjustment on both audio signals inside and outside the range specified by the start point S and the end point E, but performs the volume adjustment for one of the ranges.

In addition, the user can set the gain value to be multiplied to each audio signal inside and outside of the range specified by the start point S and the end point E by instructing the volume balance between inside and outside of the range specified by the start point S and the end point E. The volume adjustment (the volume balance adjustment) can be performed for inside and outside the range using this gain value.

As described above, by performing a series of operations from the first step to the third step, the user of the playback apparatus according to the second embodiment can operate a function for selecting specific frequency and localization angle ranges, and for adjusting the volume balance between inside and outside of the selected range. More specifically, the user selects specific frequency and localization angle ranges, and performs the volume adjustment on at least one of the volume of the audio signals inside and outside of the selected range, thereby being able to adjust the volume balance between both ranges.

Figure 9:
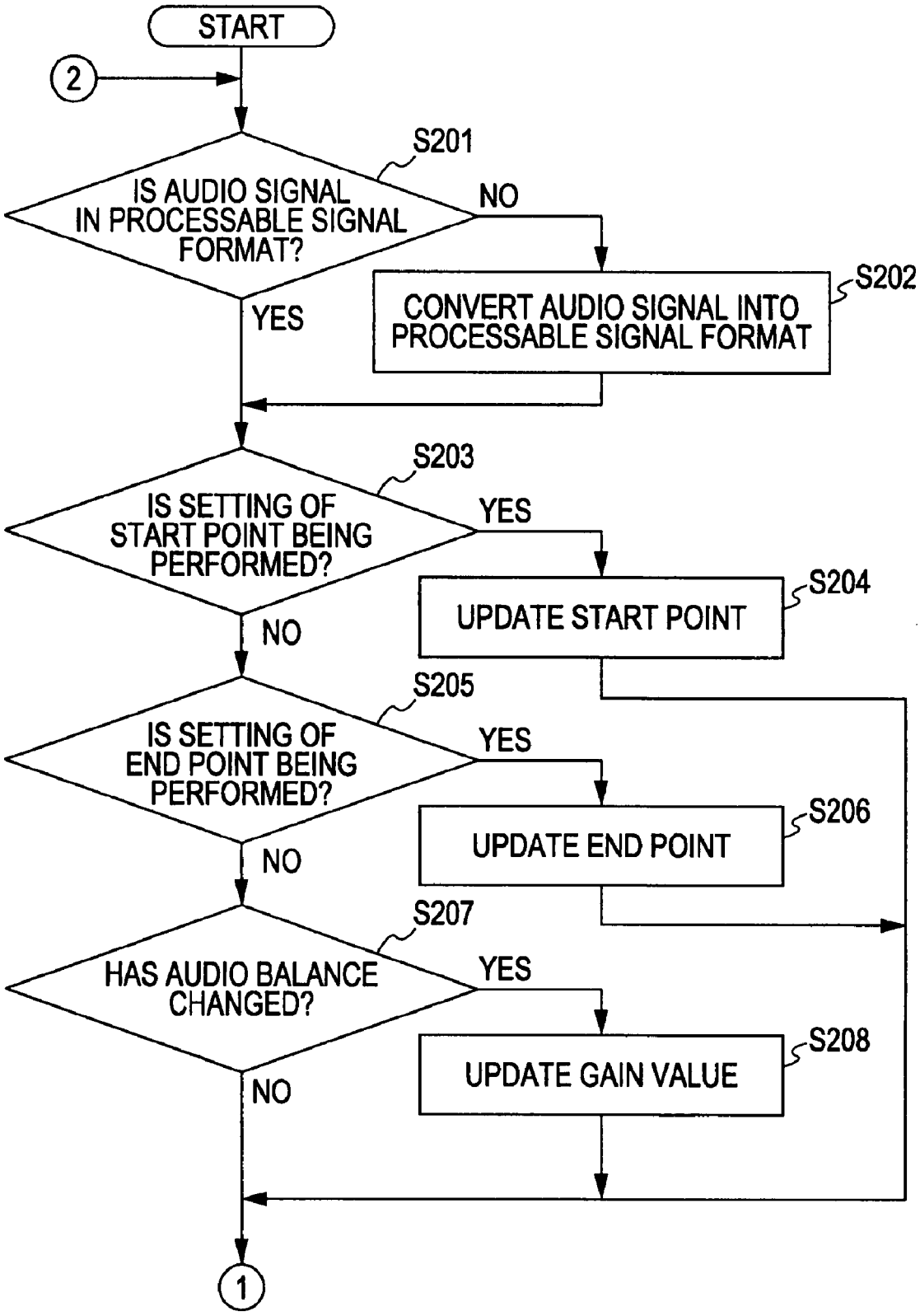
FIG. 9 is a flowchart for illustrating a procedure of an operation for displaying volume and adjusting volume balance executed by a playback apparatus according to a second embodiment of the present invention.
Figure 10:
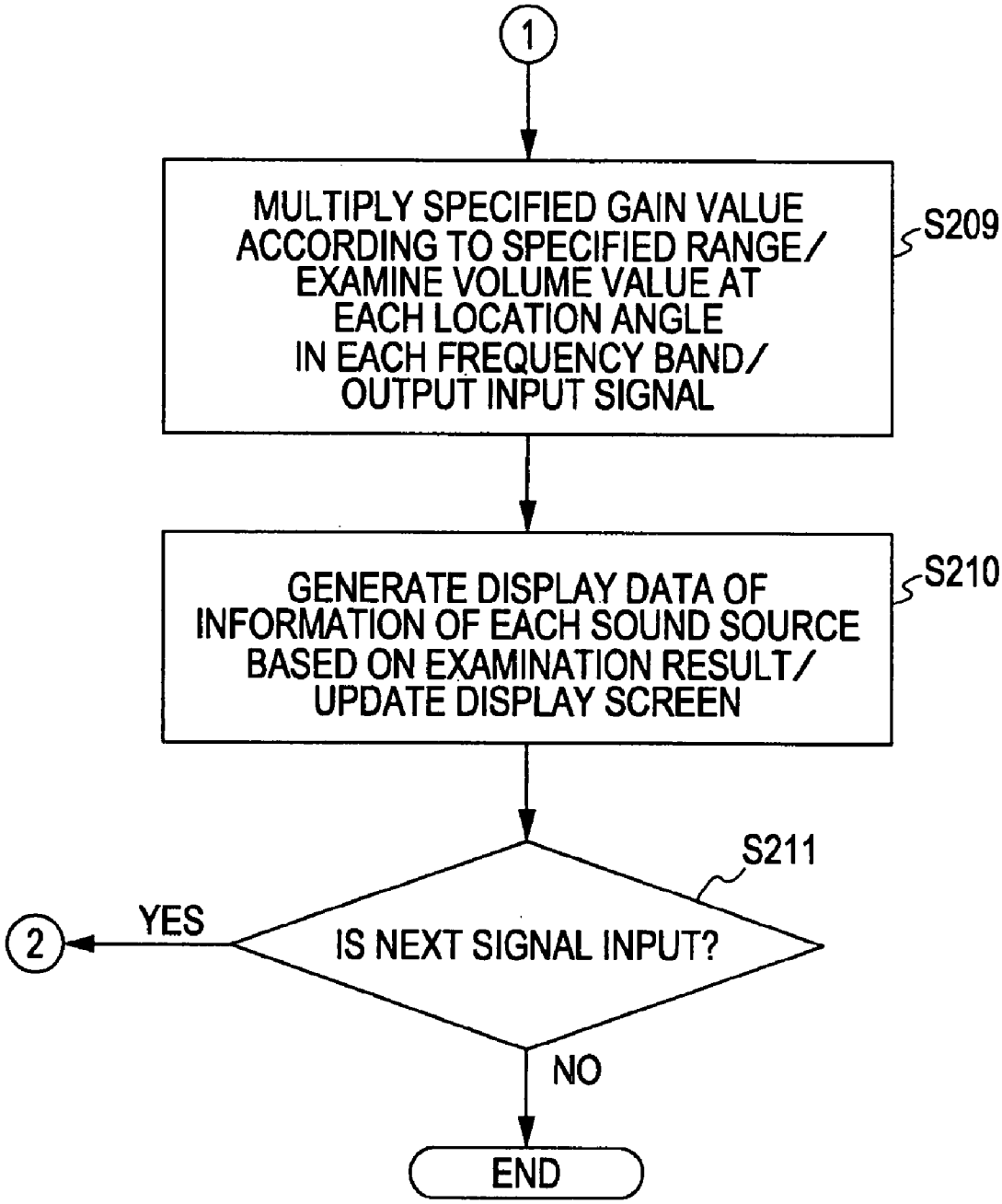
FIG. 10 is a flowchart continued from FIG. 9.

A software implementation example according to the second embodiment of the present invention will be described next. FIGS. 9 and 10 are flowcharts for illustrating processing executed by the playback apparatus 200 according to the second embodiment of the present invention. The flowcharts correspond to an example in which the embodiment of the present invention is realized as software.

The processing illustrated in FIGS. 9 and 10 is executed by the system controller 9 in cooperation with the audio signal processing unit 8 and the screen display unit 7 to play back the audio signals recorded on the recording medium loaded into the media playback unit 1 upon receiving an audio signal playback instruction through the remote commander 10 and the command receiving unit 6, for example.

As in the case of the above-described playback apparatus 100 according to the first embodiment, the system controller 9 of the playback apparatus 200 first controls the audio signal processing unit 8 to determine whether or not the audio signal to be played back is in a signal format processable by the playback apparatus (STEP S201). For example, if the audio signal to be played back is compressed according to a compression method, such as MPEG-1 audio layer 3 (MP3), or if the audio signal to be played back has a sampling frequency different from the sampling frequency of the expected signal format, the audio signal processing unit 8 cannot execute the processing in the current signal format. Accordingly, the audio signal processing unit 8 converts the format of the audio signal to be played back into a processable signal format.

That is, if a positive result is obtained in the determination operation performed at STEP S201, the process proceeds to STEP S203. On the other hand, if a negative result is obtained in the determination operation performed at STEP S201, it is indicated that the audio signal processing unit 8 cannot execute the processing on the audio signal to be played back. Thus, the process proceeds to STEP S202.

Accordingly, if the signal format of the audio signal to be played back is determined not to be a processable signal format in the determination operation performed at STEP S201, the system controller 9 controls the audio signal processing unit 8 to convert the audio signal to be played back into an audio signal in a processable signal format (STEP S202).

After performing the processing at STEP S202, or if the signal format of the audio signal to be played back is determined to be a processable signal format in the determination operation performed at STEP S201, the system controller 9 determines whether or not it is receiving the user operation for setting the start point S of a range for which the volume balance is adjusted through the remote commander 10 and the command receiving unit 6, namely, whether or not the start point is being set (STEP S203).

If the system controller 9 determines that the start point is being set in the determination operation performed at STEP S203, the system controller 9 updates the position (the position information) of the start point S, which is held therein, according to the command signal that is received from the remote commander 10 through the command receiving unit 6. In response to this update, the system controller 9 generates data for changing the display position of the pointer P, and supplies the generated data to the screen display unit 7, thereby changing the display position of the pointer P (STEP S204). Thereafter, the system controller 9 advances the process to STEP S209 shown in FIG. 10, which will be described later.

When a command signal indicating pressing of the execution key 10*e* is sent from the remote commander 10 during the processing performed at STEP S204, the position of the pointer P at that time is set as the start point S. The operation for setting the end point E can be accepted thereafter. In addition, the operation for setting the start point S is repeatedly performed until the command signal indicating pressing of the execution key 10*e* is sent from the remote commander 10.

Also, if the system controller 9 determines that the start point is not being set in the determination operation performed at STEP S203, the system controller 9 then determines whether or not it is receiving the user operation for setting the end point E of the range for which the volume balance is adjusted through the remote commander 10 and the command receiving unit 6, namely, whether or not the end point is being set (STEP S205).

If the system controller 9 determines that the end point is being set in the determination operation performed at STEP S205, the system controller 9 updates the position of the end point E according to the command signal that is received from the remote commander 10 through the command receiving unit 6. In response to this update, the system controller 9 generates data for changing the display position of the pointer P, and supplies the generated data to the screen display unit 7, thereby changing the display position of the pointer P (STEP S206). Thereafter, the system controller 9 advances the process to STEP S209 shown in FIG. 10, which will be described later.

When the command signal indicating pressing of the execution key 10*e* is sent from the remote commander 10 during the processing performed at STEP S206, the position of the pointer P at that time is set as the end point E. The operation for changing the gain value can be accepted thereafter. In addition, the operation for setting the end point E is repeatedly performed until the command signal indicating pressing of the execution key 10*e* is sent from the remote commander 10 after setting the start point S.

Also, if the system controller 9 determines that the end point is not being set in the determination operation performed at STEP S205, the system controller 9 then determines whether or not it has received the user operation for adjusting the volume balance through the remote commander 10 and the command receiving unit 6, namely, whether or not the volume balance has been changed (STEP S207).

If the system controller 9 determines that the volume balance has been changed in the determination operation performed at STEP S207, the system controller 9 updates a volume balance value, held therein, for the audio signals inside and outside the specified range according to the command signal received from the remote commander 10 through the command receiving unit 6 (STEP S208). Thereafter, the system controller 9 advances the process to STEP S209 shown in FIG. 10, which will be described later.

When the command signal indicating pressing of the execution key 10*e* is sent from the remote commander 10 during the processing performed at STEP S208, the updated volume balance value is set as a determined value. In addition, the operation for setting the volume balance is repeatedly performed until the command signal indicating pressing of the execution key 10*e* is sent from the remote commander 10 after setting the end point E.

Also, if the system controller 9 determines that the volume balance has not been changed in the determination operation performed at STEP S207, or after performing the processing at STEPs S204, S206, and S208 as described above, the system controller 9 advances the process to STEP S209 shown in FIG. 10.

The system controller 9 then controls the audio signal processing unit 8 to multiply each of the audio signals from the corresponding sound source inside the frequency and localization angle ranges specified through the user operation by the gain value determined based on the volume balance value set through the user operation. The system controller 9 also controls the audio signal processing unit 8 to multiply the audio signals from sound sources outside the frequency and localization angle ranges specified through the user operation by the gain value determined based on the volume balance value set through the user operation. The audio signal processing unit 8 is then controlled to examine the volume of the audio signal in each frequency band at each localization angle. At the same time, the audio signal processing unit 8 supplies the gain-adjusted audio signal to be played back to the D/A converter 3 to play back the audio signal (STEP S209).

Thereafter, the system controller 9 generates display data for information regarding the each audio signal from the corresponding sound source contained in the audio signal to be played back on the basis of the examination result, supplied from the audio signal processing unit 8, on the volume of the audio signal to be played back in each frequency band at each localization angle. The system controller 9 then supplies the generated data to the screen display unit 7 to update the information, regarding each audio signal from the corresponding sound source contained in the audio signal to be played back, that is displayed on the display screen of the screen display unit 7 (STEP S210).

The system controller 9 then determines whether or not the next audio signal that is continuously input to the audio signal processing unit 8 exists (STEP S211). A positive result obtained in the determination operation performed at STEP S211 indicates that the audio signal to be processed next exists. Thus, the system controller 9 repeats the processing from STEP S201 again. On the other hand, if a negative result is obtained in the determination operation performed at STEP S211, the processing target does not exist. Thus, the system controller 9 terminates the processing illustrated in FIGS. 9 and 10.

As described above, the playback apparatus 200 according to the second embodiment can realize a function to express, in each frequency band and at each localization angle, the volume values of audio signals of two or more channels by color brightness on a two-dimensional plane that uses the frequency and the localization angle as two axes as in the case of the playback apparatus 100 according to the first embodiment. A function for allowing selection of a specific range through the user operation and for adjusting the volume balance between inside and outside the range is also realized.

As described above, it is possible to select a specific frequency range and a specific localization angle range through the user operations and to adjust the volume balance between inside and outside of the selected range. Thus, in the case that the audio signal to be played back is a music audio signal, the variety of ways to enjoy the contents, such as making sounds of a target musical instrument stand out, or making the singing voice stand out and background music moderate, can be increased.

[Modifications of Second Embodiment]

In the above-described playback apparatus 200 according the second embodiment, the frequency range and the localization angle range are set through the remote commander 10. However, the setting method is not limited to this particular example. For example, a display screen 7G of a screen display unit 7 may have a touch panel function, thereby allowing users to perform the setting more easily.

Figure 11:
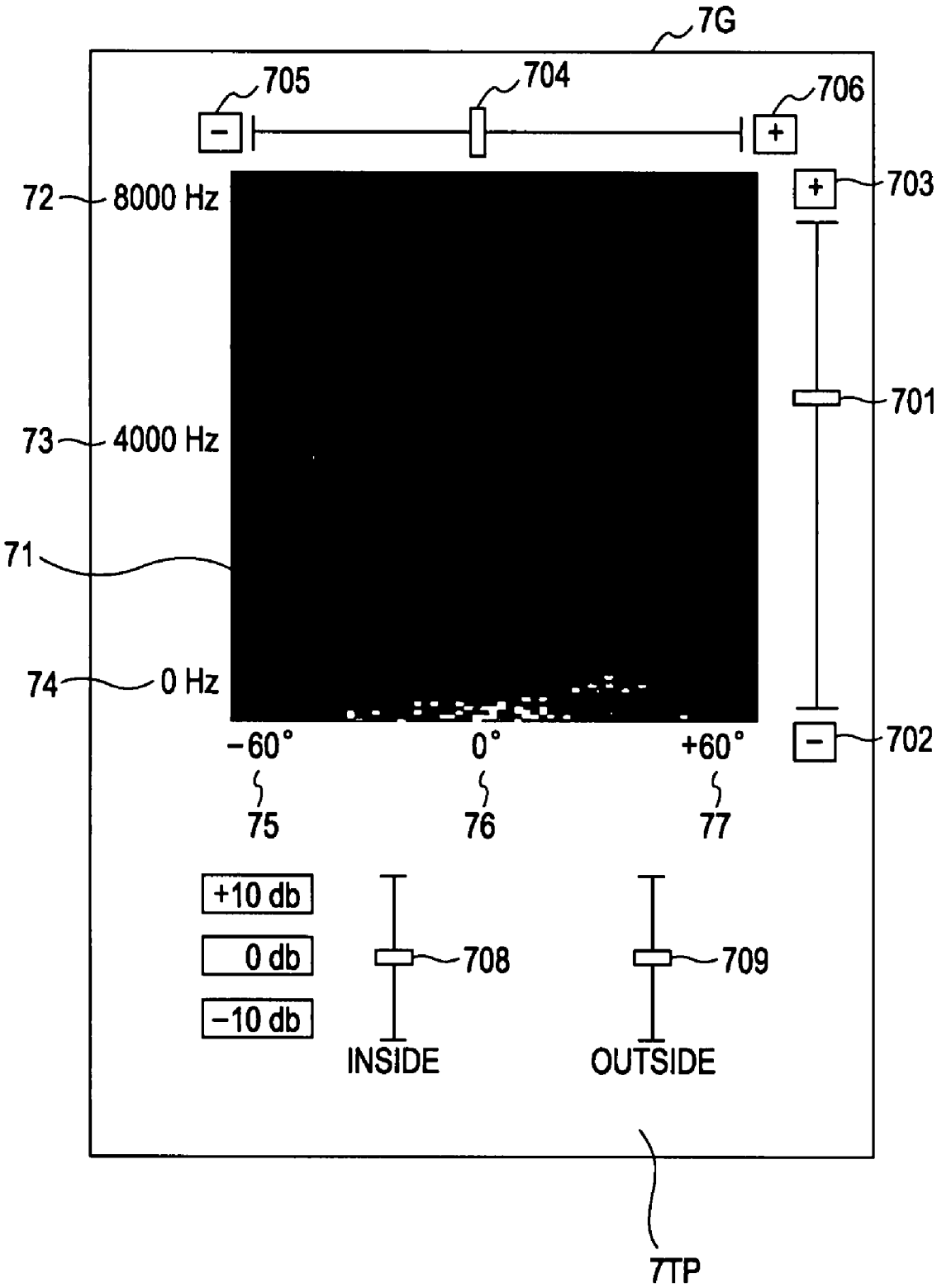
FIG. 11 is a diagram for illustrating an example of a screen displayed on a display screen 7G, on which a touch panel is provided.

FIG. 11 illustrates an example screen displayed on the display screen 7G of the screen display unit 7, on which a touch panel is provided. As shown in FIG. 11, a touch panel 7TP is provided on the display screen 7G of the screen display unit 7. A function for receiving user input operations is realized by images displayed on the display screen 7G and the touch panel 7TP.

More specifically, a system controller 9 knows kinds of display images and positions on the display screen 7G where the images are displayed. If the touch panel 7TP is touched with a pen or a finger, the touch panel 7TP supplies the system controller 9 with an electric signal corresponding to coordinate data that indicates the touched position. In addition, if a so-called drag operation is performed, the touch panel 7TP supplies the system controller 9 with electric signals corresponding to coordinate data indicating the touched position that changes momentarily.

The system controller 9 can determine a kind of processing to be executed on the basis of the coordinate data supplied from the touch panel 7TP and the information regarding the image displayed at the position on the display screen 7G indicated by the coordinate data, and can execute the determined processing. Detailed description will be given for a case in which a frequency range and a localization angle range are specified through operations performed on such a touch panel 7TP and then a volume balance is changed.

In a modification of the second embodiment, the display screen 7G of the screen display unit 7 also includes a volume display portion 71, which is an area for displaying information regarding each sound source contained in an audio signal to be played back. Referring to FIG. 11, reference numerals 72, 73, and 74 indicate values of the corresponding frequencies, whereas reference numerals 75, 76, and 77 indicate values of the corresponding localization angles.

More specifically, as in the case of the volume display portion 71 shown in FIGS. 2 and 6, the horizontal axis, the vertical axis, and the color brightness represent the localization angle of a sound image of each sound source, the frequency, and the volume level of each audio signal from the corresponding sound source, respectively, in this volume display portion 71. That is, three elements, i.e., the localization angle, the frequency, and the volume, are represented using three elements, i.e., the horizontal axis, the vertical axis, and the color brightness.

In addition, by performing a drag operation with a pen or a finger on the touch panel 7TP provided on the volume display portion 71, the frequency range and the localization angle range can be specified. More specifically, a user touches a given point on the touch panel 7TP provided on the volume display portion 71 with a pen or a finger, and moves the contact point to another point while keeping the contact, and then releases the contact.

By means of a so-called "drag and drop" operation, the system controller 9 sets the point where the user first touched with a pen or the like as a start point S and the point where the user released the contact with a pen or the like as an end point E on the basis of the coordinate data supplied from the touch panel 7TP and the corresponding display information. The system controller 9 then sets inside of a rectangle having the start point S and the end point E as its vertices on a diagonal line as a specified range, thereby allowing the user to set the frequency range and the localization angle range for which the volume balance is changed.

In addition, referring to FIG. 11, a slider 701 and buttons 702 and 730 are used for changing the frequency range displayed on the volume display portion 71. More specifically, if a user touches a part of the slider 701 that is higher than the current position of the slider, the position of the slider 701 is changed to the upper position, and the frequency range displayed on the volume display portion 71 is also shifted upward in response to the positional change.

For example, as shown in FIG. 11, when the slider 701 is positioned at the center, a frequency range of 0 Hz to 8000 Hz is displayed. In response to upward sliding of the slider 701 by a quarter of the entire length of the slider, the system controller 9 shifts the frequency range displayed on the volume display portion 71 to a range of 2000 Hz to 10000 Hz.

In addition, if a user touches an area of the touch panel 7TP where the button 702 is displayed with a pen or a finger, the frequency range to be displayed on the volume display portion 71 is narrowed. For example, as shown in FIG. 11, the frequency range to be displayed is a range of 0 Hz to 8000 Hz. If the user touches the area of the touch panel 7TP where the button 702 is displayed with a pen or a finger, the system controller 9 narrows the frequency range displayed on the volume display portion 71 to a range of 0 Hz to 4000 Hz.

Additionally, if a user touches an area of the touch panel 7TP where the button 703 is displayed with a pen or a finger, the frequency range to be displayed on the volume display portion 71 is expanded. For example, as shown in FIG. 11, the frequency range to be displayed is a range of 0 Hz to 8000 Hz. If the user touches the area of the touch panel 7TP where the button 703 is displayed with a pen or a finger, the system controller 9 expands the frequency range displayed on the volume display portion 71 to a range of 0 Hz to 16000 Hz.

In this manner, it is possible to change the frequency range to be displayed on the volume display portion 71 using the slider 701 and the buttons 702 and 703. The frequency values indicated by reference numerals 72, 73, and 74 are also changed in response to changing of the frequency range through the user operations.

Furthermore, referring to FIG. 11, a slider 704 and buttons 705 and 706 are used for changing the localization angle range to be displayed on the volume display portion 71. More specifically, if a user touches a part of the slider 704 to the left of the current position of the slider, the position of the slider 704 is changed to the left, and the localization angle range to be displayed on the volume display portion 71 is also shifted to the left in response to the positional change.

For example, as shown in FIG. 11, when the slider 704 is positioned at the center, the localization angle range of −60 degrees to +60 degrees is displayed. If the slider 704 is shifted to the left by a quarter of the entire length of the slider, the system controller 9 shifts the localization angle range to be displayed on the volume display portion 71 to a range of −90 degrees to +30 degrees.

In addition, if a user touches an area of the touch panel 7TP where the button 705 is displayed with a pen or a finger, the localization angle range to be displayed on the volume display portion 71 is narrowed. For example, as shown in FIG. 11, the localization angle range to be displayed is set to a range of −60 degrees to +60 degrees. At this time, if the user touches the area of the touch panel 7TP where the button 705 is displayed with a pen or a finger, the system controller 9 narrows the localization angle range to be displayed on the volume display portion 71 to a range of −30 degrees to +30 degrees.

Additionally, if a user touches an area of the touch panel 7TP where the button 706 is displayed with a pen or a finger, the localization angle range to be displayed on the volume display portion 71 is expanded. For example, as shown in FIG. 11, the localization angle range to be displayed is set to a range of −60 degrees to +60 degrees. At this time, if the user touches the area of the touch panel 7TP where the button 706 is displayed with a pen or a finger, the system controller 9 expands the localization angle range to be displayed on the volume display portion 71 to a range of −120 degrees to +120 degrees.

In this manner, it is possible to change the localization angle range to be displayed on the volume display portion 71 using the slider 704 and the buttons 705 and 706. The localization angle values indicated by reference numerals 75, 76, and 77 are also changed in response to changing of the localization angle range through the user operations.

Moreover, referring to FIG. 11, a slider 708 is used for setting a gain value for audio signals inside the frequency and localization angle ranges specified through the user operation. More specifically, if a user touches a part of the slider 708 that is higher than the current position of the slider, the position of the slider 708 is changed to the upper position, and the gain value for audio signals inside the specified range is also increased in response to the positional change.

For example, as shown in FIG. 11, when the slider 708 is positioned at the center of a changeable range, the gain value at this time is set to 0 dB. If the slider 708 is shifted upward by a quarter of the entire length of the slider, the system controller 9 increases the gain value for audio signals inside the specified frequency and localization angle ranges to +5 dB.

Additionally, referring to FIG. 11, a slider 709 is used for setting the gain value for audio signals outside the frequency and localization angle ranges specified through the user operation. More specifically, if a user touches a part of the slider 709 that is higher than the current position of the slider, the position of the slider 709 is changed to the upper position, and the gain value for audio signals outside the specified range is also increased in response to the positional change.

For example, as shown in FIG. 11, when the slider 709 is positioned at the center of a changeable range, the gain value at this time is set to 0 dB. If the slider 709 is shifted upward by a quarter of the entire length of the slider, the system controller 9 increases the gain value for audio signals outside the specified frequency and localization angle ranges to +5 dB.

As described above, the playback apparatus 100 according to the first embodiment can express, in each frequency band and at each localization angle, the volume values of audio signals of two or more channels by the color brightness on a two-dimensional plane defined by two axes of the frequency and the localization angle. The above-described playback apparatus according to the second embodiment is an improvement of the playback apparatus according to the first embodiment, and has a function to select a specific range through the user operations and to adjust the volume balance between inside and outside of the selected range.

[Other Embodiments]

In the above-described first and second embodiments, two-channel (Lch and Rch) audio signals are used as the audio signals to be played back. However, the audio signals to be played back are not limited to this particular example, and audio signals of two or more channels can also be supported. More specifically, the embodiments of the preset invention can be applied to processing of multi-channel audio signals, such as 4 ch, 5 ch, 5.1 ch, 7.1 ch, and 9.1 ch.

In addition, in the above-described first and second embodiments, the media playback unit 1 has been described as one that plays back audio signals (and video signals) from a recording medium. However, the configuration is not limited to this particular example. The embodiments of the preset invention can also be applied to a playback apparatus that employs a tuner, for receiving and demodulating various broadcast signals, such as an amplitude modulation (AM) broadcast signal, a frequency modulation (FM) broadcast signal, a television broadcast signal, and a satellite broadcast signal, to output audio signals (and video signals), instead of the media playback unit 1.

Alternatively, the embodiments of the present invention can also be applied to an audio signal processing apparatus, which receives, as an amplifier, for example, an audio signal played back (received) outside and which performs audio signal processing on this input audio signal, instead of the playback apparatus having the media playback unit 1 or the turner.

In addition, in the above-described first and second embodiments, the volume level is displayed on the volume display portion 71 of the display screen 7G of the screen display unit 7 so that the color becomes whitish as the volume level becomes higher, whereas the color becomes blackish as the volume level becomes lower. The opposite case is also employable. More specifically, the color becomes blackish as the volume level becomes higher, whereas the color becomes whitish as the volume level becomes lower.

Additionally, color display may be used to display the information on the volume display portion 71 of the display screen 7G of the screen display unit 7. For example, display colors may be changed for each of the predetermined frequency bands or for each localization angle range. A darker color may indicate a higher volume level, whereas a paler color may indicate a lower volume level. Conversely, a paler color may indicate a higher volume level, whereas a darker color may indicate a lower volume level.

Furthermore, in addition to displaying the volume level by color, the information may be displayed on the volume display portion 71 of the display screen 7G of the screen display unit 7 in a three-dimensional format. The information may also be three-dimensionally expressed on a three-dimensional screen instead of a two-dimensional screen. Additionally, the values for the vertical axis and the horizontal axis may be switched. More specifically, the localization angle and the frequency may be assigned to the vertical axis and the horizontal axis, respectively.

In the second embodiment, given frequency and localization angle ranges are selected and the volume balance between inside and outside the selected range is adjusted by operating the right key 10*a*, the left key 10*b*, the upward key 10*c*, the downward key 10*d*, and the execution key 10*e* of the remote commander 10. The range may be specified by procedures or methods other than this example. Also, the range may be specified using operation devices and pointing devices, such as a mouse and a touch panel, other than the remote commander.

For example, in the case of using a mouse, a user may press a mouse button to set the start point, and may perform a drag operation (move the position of a cursor with a mouse operation) to move the cursor to the end point, and then may release the mouse button to set the end point. In addition, a rectangle having the start point and the end point as the vertices on a diagonal line is used when setting given frequency and localization angle ranges. However, a circle or an oval may also be used, and the inside thereof is set as the target specified range.

When setting the frequency and localization angle ranges, the center of a circle may be used as the start point and the radius of the circle may be used as the end point, and the inside of the circle may be set as the specified range. In addition, when setting the frequency and localization angle ranges, the inside of a closed curb that is drawn by a user with a mouse or a touch panel may be set as the target specified range. That is, any procedures, methods, and devices may be adaptable as long as the range can be specified.

In the second embodiment, only one frequency and localization angle range can be selected. A plurality of ranges may be selected, and the volume balance may be changed for each range.

Figure 12A:
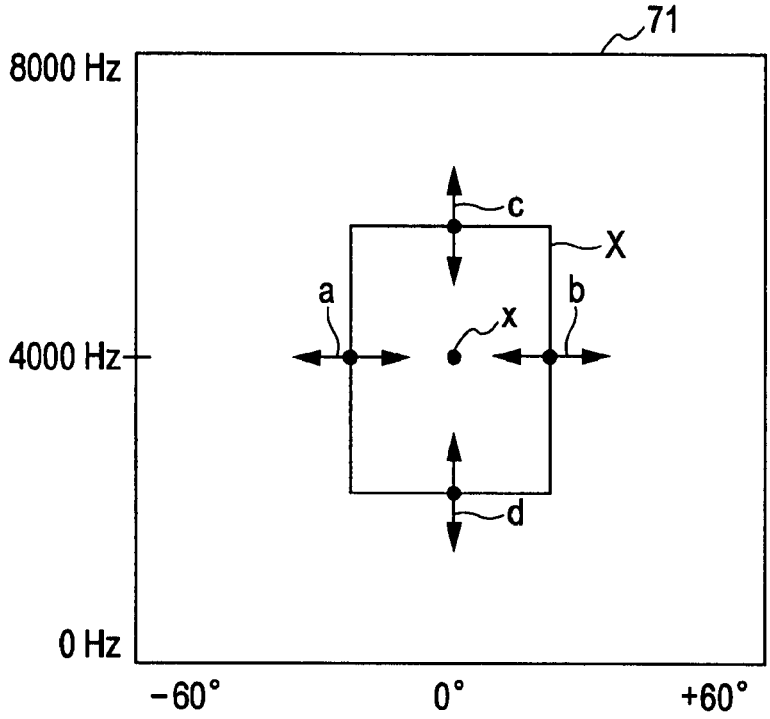
FIGS. 12A and 12B are diagrams for illustrating another example for setting a frequency range and a localization angle range.

FIGS. 12A and 12B and FIGS. 13A and 13B illustrate other examples for setting frequency and localization angle ranges. In the case of FIG. 12A, for example, if a user specifies a given point x with a pointing device, predetermined frequency and localization angle ranges are selected while using the point x as the center. In such a manner, the frequency and localization angle ranges are set.

More specifically, in the case of FIG. 12A, the localization angle range of 10 degrees for each side and a frequency range of 2000 Hz each for upper and lower sides are set while using the first specified point x as the center. In such a manner, a rectangular range X is automatically set as shown in FIG. 12A. For example, this range X can be reduced or enlarged by moving each of four sides of the rectangle as shown by arrows a, b, c, and d in FIG. 12A. Furthermore, three other sides may be moved in response to movement of one-side to adjust the four sides at the same time, thereby being able to reducing or enlarging the rectangle in four directions.

Figure 12B:
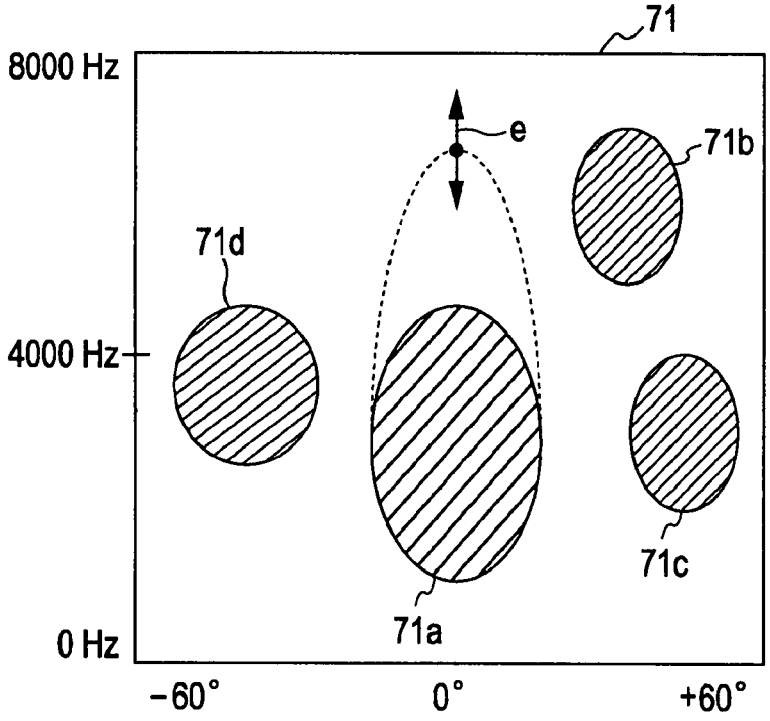

FIG. 12B is an example in which a range (an initial range) that is set by specifying one given point is generated as an oval. As in the case of the example shown in FIG. 12A, in the case of FIG. 12B, for example, if a user specifies a given point x, a vertically oriented oval range is set using the point x as the center. As indicated by an arrow e in FIG. 12B, this range can be enlarged or reduced.

Although the frequency and localization angle ranges are set using an oval here, the shape is not limited to this particular example. As described above, a user can specify the target range by specifying a range using a circle, a half circle, or various other shapes and by changing the shape of the range.

In addition, as indicated by ranges 71*a*, 71*b*, 71*c*, and 71*d* in FIG. 12B, a plurality of separation angle ranges (frequency and localization angle ranges) can be set. In this case, the volume level of each of the specified ranges 71*a*, 71*b*, 71*c*, and 71*d* and of a part other than these ranges can be adjusted by specifying the volume level of each of the specified ranges 71*a*, 71*b*, 71*c*, and 71*d* and of the part other than these ranges.

More specifically, the volume levels of audio signals from musical instruments that correspond to the ranges 71*a*, 71*b*, 71*c*, and 71*d* can be turned up, and the volume levels of audio signals from other musical instruments and of noise can be turned down. Conversely, the adjustment can be performed so that the volume levels from sound sources for the specified ranges 71*a*, 71*b*, 71*c*, and 71*d* are turned down, and the volume levels from other sound sources are turned up.

That is, it is possible to set a range to which a target sound source belongs according to an arrangement of each sound source contained in audio contents, and to adjust the volume level. In other words, it is possible to set the level of the adjustment to be performed on the audio signals from sound sources existing in a range (a frequency range, a range of localization angle of a sound image, or a range specified by both ranges) and to perform the adjustment according to the set level.

Figure 13A:
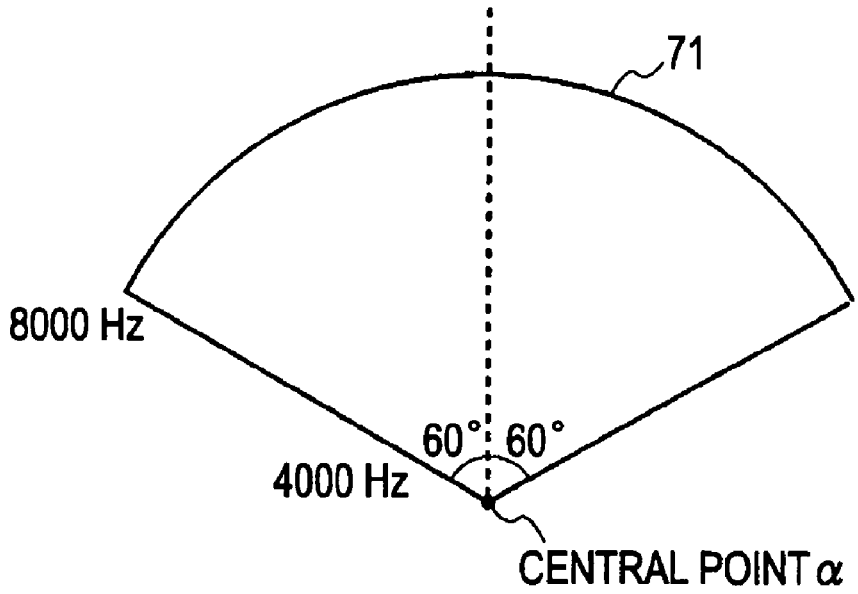
FIGS. 13A and 13B are diagrams for illustrating another example for setting a frequency range and a localization angle range.
Figure 13B:
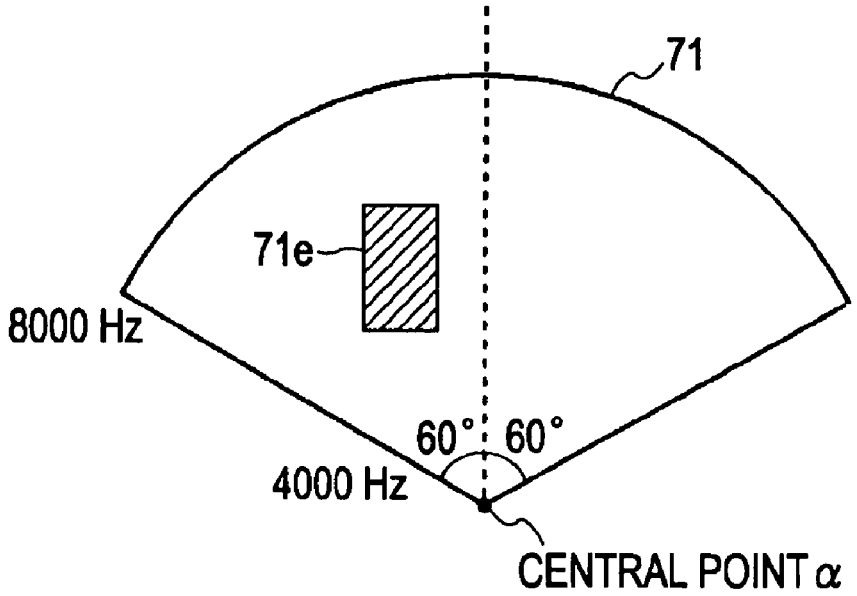

As shown in FIGS. 13A and 13B, the shape of the volume display portion 71 may be a sector. In this case, as shown in FIG. 13A, a central angle of the sector is set to match the localization angle range. The radius direction in the radius part at both ends of the arc indicates the frequency range. With such a configuration, the position of the target sound source contained in the audio signal can be displayed while considering the center $\alpha$ of the sector as the position of a listener so that the listener can understand the position more intuitively.

For example, when a user specifies a range including a sound source whose sound image is localized on the left of the listener, the user sets a range 71*e* at a target part on the left of the center as illustrated in FIG. 13B, and reduces or enlarges the range or changes the position of the range, thereby being able to set the frequency and localization angle ranges that the target sound source belongs to. The shape of the volume display portion 71 is not limited to a square or a sector, and may be various shapes, such as a circle, an oval, a rhombus, and a trapezoid.

Although the volume balance between inside given frequency and localization angle ranges and outside the selected ranges can be changed in the second embodiment, signal processing other than this can be performed. For example, signal processing may be performed on only audio signals from sound sources that exist inside the selected range so that the localization position thereof approaches the listener. Additionally, signal processing may be performed so that sound sources that exist inside the specified range are moved to another position.

In each of the embodiments, musical instruments may be identified on the basis of frequency characteristics and harmonic components of each musical instrument, and an image or a name of the musical instrument may be displayed on the volume display portion 71 of the screen display unit 7.

As described above, the embodiments of the present invention can be applied not only to an audio signal playback apparatus but also various electronic devices that process audio signals and content signals containing so-called audio/visual signals of audio signals and video signals to be synchronously played back. The various electronic devices include a receiving apparatus having a broadcast signal receiving/demodulating function, a personal computer having a music/video playback function, an audio signal processing apparatus, such as a power amplifier, that receives audio signals and performs audio signal processing, such as amplification.

A function realized by the embodiments of the present invention can be installed relatively easily by creating a program (software) for causing execution of the processing described using the flowcharts of FIGS. 3, 9, and 10 and then installing the program in various electronic devices that process content signals.

In addition, the information indicating the frequency and localization angle ranges specified in the above-described manner, and the information indicating the gain value or the volume balance regarding at least one of audio signals inside and outside of the range may be stored for example, in a memory of the system controller 9 in association with identifiers of contents to be processed. With this configuration, the content can be played back according to the user's preference after performing the gain adjustment (the volume balance adjustment) on at least one of the audio signals inside and outside of the specified range in the specified manner each time the content is played back.

Additionally, the information indicating the frequency range and the localization angle range that are specified in the above-described manner, and the information indicating the gain value or the volume balance regarding at least one of audio signals inside and outside of the range may be stored, for example, in a memory of the system controller 9. When processing various kinds of audio signals, any contents can be played back according to the user's preference at any time after performing the gain adjustment (the volume balance adjustment) on the basis of the stored information.

Furthermore, the information indicating a plurality of frequency ranges and a plurality of localization angle ranges, and the information indicating the gain value or the volume balance regarding at least one of audio signals inside and outside of the range may be stored, for example, in a memory of the system controller 9 in accordance with the kinds of contents to be played back. With this configuration, the contents can be played back according to the volume preferred by the user at any time in accordance with the kinds of contents to be played back.

In addition, the information of the specified frequency range and localization angle range, and the information indicating the gain value or the volume balance regarding at least one of audio signals inside and outside of the range may be attached to the content data, such as audio signals. For example, when the content data is provided to other devices, the contents can be played back in the other devices on the basis of the specified frequency range and localization angle range and the information indicating the gain value regarding at least one of the audio signals inside and outside of the range.

Moreover, the information indicating the specified frequency range and localization angle range, and the information indicating the gain value or the volume balance regarding at least one of audio signals inside and outside the range may be applied to the entire or a predetermined part of content data, such as audio signals.

In this case, for example, a user may only instruct application of the information to the entire content or instruct an application period using the time, the number of frames, and other information that allows specification of a point of the content. For example, the period may be specified as a period from the point at which predetermined seconds has passed from the top or a period between given frame numbers from the top.

In addition, a plurality of pieces of information indicating the specified frequency ranges and localization angle ranges, and a plurality of pieces of information indicating the gain value or the volume balance regarding at least one of audio signals inside and outside the range may provided for content data, such as audio signals. The information to be used may be selected, and the gain adjustment (the volume balance adjustment) may be performed using the selected information.

It should be understood by those skilled in the art that various modifications, combinations, sub-combinations and alterations may occur depending on design requirements and other factors insofar as they are within the scope of the appended claims or the equivalents thereof.

What is claimed is:

1. An audio signal processing apparatus that examines, in each frequency band and at each localization angle, volume of an audio signal of two or more channels, the audio signal processing apparatus comprising:

at least one controller that generates, on the basis of an examination result of examining the volume of the audio signal of two or more channels, display data for a two-dimensional visual representation showing a volume value in each frequency band and at each localization angle on an area that displays a frequency and a localization angle.

2. The audio signal processing apparatus to claim 1, wherein the audio signal processing apparatus is configured to:

receive a specification regarding a range of the audio signal through an image displayed according to the display data receive an instruction that adjusts at least one of the volume inside the range and the volume outside the range; and adjust at least one of a volume of the audio signal inside the range and a volume of the audio signal outside the range according to the instruction.

3. The audio signal processing apparatus according to claim 1, further comprising a display that displays an image corresponding to the display data.

4. The audio signal processing apparatus according to claim 3, wherein the audio signal processing apparatus is configured to change a frequency bandwidth that is displayed on the display.

5. The audio signal processing apparatus according to claim 3, wherein the audio signal processing apparatus is configured to change an upper limit and a lower limit of a frequency band while maintaining a frequency bandwidth that is displayed on the display.

6. The audio signal processing apparatus according to claim 3, wherein the audio signal processing apparatus is configured to change a width of a localization angle range that is displayed on the display.

7. The audio signal processing apparatus according to claim 3, wherein the audio signal processing apparatus is configured to change an upper limit and a lower limit of a localization angle range while maintaining a width of a localization angle range that is displayed on the display.

8. The audio signal processing apparatus according to claim 1, wherein the display data is generated to show the volume value through color.

9. The audio signal processing apparatus according to claim 1, wherein the area that displays the frequency and the localization angle includes Cartesian coordinates representing the frequency and the localization angle as two axes.

10. The audio signal processing apparatus according to claim 1, wherein the area that displays the frequency and the localization angle includes polar coordinates representing the frequency as a radial distance from a pole and the localization angle as a polar angle.

11. An audio signal processing method comprising the steps of examining, in each frequency band and at each localization angle, volume of an audio signal of two or more channels; and generating, based on an examination result output by the act of examining, display data for a two-dimensional visual representation showing a volume value in each frequency band and at each localization angle on an area that displays a frequency and a localization angle.

12. An apparatus having stored thereon a program, which, when executed, causes a computer mounted on an audio signal processing apparatus to execute a process, the process comprising:

examining, in each frequency band and at each localization angle, volume of an audio signal of two or more channels; and generating, based on an examination result output by the act of examining, display data for a two-dimensional visual representation showing a volume value in each frequency band and at each localization angle on an area that displays a frequency and a localization angle.

13. An audio signal processing apparatus that examines, in each frequency band and at each localization angle, volume of an audio signal of two or more channels, the audio signal processing apparatus comprising:

generating means for generating, based on an examination result of examining the volume of the audio signal of two or more channels, display data for a two-dimensional visual representation showing a volume value in each frequency band and at each localization angle on an area that displays a frequency and a localization angle; and a display that displays the display data.

14. The audio signal processing apparatus according to claim 1, wherein the at least one controller generates the display data for showing the volume value using brightness.

15. The audio signal processing apparatus according to claim 1, wherein the at least one controller generates the display data for showing the volume value using color brightness.

* * * * *